US007221349B2

(12) United States Patent
Hashido et al.

(10) Patent No.: US 7,221,349 B2
(45) Date of Patent: May 22, 2007

(54) DISPLAY DEVICE WITH LIGHT EMITTING ELEMENTS

(75) Inventors: Ryuichi Hashido, Hyogo (JP); Hidetada Tokioka, Hyogo (JP); Masafumi Agari, Hyogo (JP); Suehiro Goto, Hyogo (JP); Takahiro Urakabe, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 592 days.

(21) Appl. No.: 10/841,449

(22) Filed: May 10, 2004

(65) Prior Publication Data

US 2004/0251844 A1 Dec. 16, 2004

(30) Foreign Application Priority Data

May 28, 2003 (JP) ..... 2003-150918

(51) Int. Cl.
*G09G 3/36* (2006.01)

(52) U.S. Cl. ..... 345/89; 345/76; 345/82; 315/169.1

(58) Field of Classification Search ..... 345/76, 345/89, 82, 605, 639; 315/169.1, 169.3, 315/169.4
See application file for complete search history.

(56) References Cited

U.S. PATENT DOCUMENTS 6,151,005 A * 11/2000 Takita et al. ..... 345/89
6,329,974 B1 * 12/2001 Walker et al. ..... 345/98
6,556,176 B1 4/2003 Okuyama et al.
6,774,877 B2 * 8/2004 Nishitoba et al. ..... 345/76
6,828,950 B2 * 12/2004 Koyama ..... 345/76
6,870,553 B2 * 3/2005 Kondo et al. ..... 345/690
7,019,717 B2 * 3/2006 Yumoto et al. ..... 345/76
2002/0175926 A1 * 11/2002 Miyazawa ..... 345/690
2003/0020705 A1 * 1/2003 Kondo et al. ..... 345/212
2003/0146888 A1 8/2003 Yamazaki et al.

(Continued)

FOREIGN PATENT DOCUMENTS

JP 2000-276108 10/2000

(Continued)

OTHER PUBLICATIONS

Yumoto et al., "Pixel-Driving Methods for Large-Sized Poly-Si AM-OLED Displays", *Asia Display/IDW'01*, 2001, pp. 1395-1398.

*Primary Examiner*—Richard Hjerpe
*Assistant Examiner*—Kimnhung Nguyen
(74) *Attorney, Agent, or Firm*—Leydig, Voit & Mayer, Ltd.

(57) ABSTRACT

A display current of a whole gray scale range according to a display signal of four bits is produced from a sum of output currents of an analog current supply circuit producing a first output current according to lower data bits and two digital current supply circuits operating in accordance with corresponding data bits to execute or stop generation of second and third output currents according to higher data bits. The analog current supply circuit has a calibration function of compensating for output current variations due to transistor characteristics at one point in a control range of the first output current. A display device with light-emitting elements can accurately generate a display current for gray-scale expression without imposing an excessive load on a manufacturing process while suppressing circuit footprint.

20 Claims, 20 Drawing Sheets

U.S. PATENT DOCUMENTS

| | | | | |
|---|---|---|---|---|
| 2003/0178946 | A1* | 9/2003 | Nakamura et al. | 315/169.3 |
| 2004/0036457 | A1 | 2/2004 | Tokioka et al. | |
| 2004/0108998 | A1* | 6/2004 | Imamura | 345/204 |

FOREIGN PATENT DOCUMENTS

| | | |
|---|---|---|
| JP | 2003-280587 | 10/2003 |
| JP | 2003-280594 | 10/2003 |
| WO | WO 98/48403 | 10/1998 |

* cited by examiner

DISPLAY DEVICE WITH LIGHT EMITTING ELEMENTS

BACKGROUND OF THE INVENTION

1. Field of the Invention

The present invention relates to a display device, and particularly to a display device including a light-emitting element, such as an organic EL (Electro Luminescence), which varies its light-emitting luminance according to a drive current, in each of pixels and executing gray-scale expression based on a digital signal.

2. Description of the Background Art

As a display device of a flat-panel type, attention has been given to a display device of a self-light-emitting type, in which each pixel is formed of a light-emitting element of a current drive type. The display device of the self-light-emitting type has high visibility as well as high moving picture quality. A light-emitting diode (LED) is well known as a kind of light-emitting element of the current drive type.

Generally, a display device includes a plurality of pixels, which are arranged in rows and columns, and are successively driven by dot-sequential scanning or line-sequential scanning to receive a display current. Each pixel element keeps brightness corresponding to the display current thus received until its next driving. The display current received by each pixel is usually formed of an analog current for achieving gray-scale expression. This analog current can be set to a level intermediate between maximum (white) and minimum (black) luminance levels of each light-emitting element so that each pixel can execute the gray-scale expression.

Therefore, the display device provided with the light-emitting elements of the current drive type requires a current supply circuit for accurately producing the analog current (which may also be referred to as the "data current" hereinafter) according to the display signal.

FIG. 21 is a circuit diagram showing a structure of a general current supply circuit.

Referring to FIG. 21, a general current supply circuit 300 includes an n-channel TFT (which will be referred to as an "n-type TFT" hereinafter) 301, which is used as a current drive element, a switch 303 and a capacitor 305. In the specification, the TFT (Thin Film Transistor) is described as a typical example of a field-effect transistor.

n-type TFT 301 has a source and a drain, which are electrically connected to a predetermined voltage Vss and an output node No, respectively. A gate of n-type TFT 301 is connected to a node Ng. When switch 303 is turned on, an input voltage Vin is transmitted to node Ng, i.e., a gate of n-type TFT 301. A capacitor 305 is connected between predetermined voltage Vss and the gate of n-type TFT 301, and holds voltage difference between a gate voltage and predetermined voltage Vss, i.e., a gate-source voltage (which will be merely referred to as a "gate voltage" hereinafter) of n-type TFT 301.

Capacitor 305 holds input voltage Vin, which is transmitted to the gate of n-type TFT 301 when switch 303 is turned on. Consequently, n-type TFT 301 keeps the gate voltage equal to input voltage Vin. As can be understood from a circuit structure, the current drive element may be formed of a p-type field-effect transistor instead of the n-type transistor. The typical example, which will now be described, uses a ground voltage as predetermined voltage Vss.

A drain current Id in a saturation region of a field-effect transistor such as a TFT can be generally represented by the following formula (1):

$$Id=(\beta/2)\cdot(Vgs-Vth)^2 \quad (1)$$

where β is equal to μ·(W/L)·Cox (i.e., β=μ·(W/L)·Cox).

In the above formula, β represents a current coefficient, μ represents an average surface mobility (which may be merely referred to as a "mobility" hereinafter), L represents a gate channel length, W represents a gate channel width, Cox represents a gate channel capacitance (per unit area), and Vth represents a threshold voltage.

In current supply circuit 300, therefore, when output node No is driven by a voltage different from predetermined voltage Vss, an output current Io corresponding to input voltage Vin is provided on output node No.

In current supply circuit 300, however, output current characteristics significantly depend on the characteristics of the current drive element, i.e., n-type TFT 301. If manufacturing variations, i.e., variations due to manufacturing occur in the characteristics (e.g., threshold voltage Vth and mobility μ) of n-type TFT 301, the output current characteristics significantly change.

FIG. 22 is a diagram illustrating a relationship between an input voltage and an output current of the current supply circuit shown in FIG. 21.

FIG. 22 illustrates I-V characteristic lines 310 and 320 of circuits, which use two TFTs (i.e., TFTa and TFTb) having different characteristics as n-type TFT 301 shown in FIG. 21, respectively. Also, FIG. 22 illustrates examples, in which four levels V1–V4 are selected as the levels of input voltage Vin, respectively.

As can be seen from I-V characteristic line 310, when TFTa is used, output current Io attains levels of I1*a*–I4*a* corresponding to input voltage V1–V4, respectively. As can be seen from I-V characteristic line 320, when TFTb is used, output current Io attains levels of I1*b*–I4*b* corresponding to input voltages V1–V4, respectively. Thus, output current variations ΔI1–ΔI4 unpreferably occur corresponding to input voltages V1–V4 due to difference in transistor characteristics, respectively.

If output current variation ΔI4 (=|I4*b*–I4*a*|), which appears when voltage V4 achieving the highest gray level is input, is larger than output currents I1*a* and I1*b* corresponding to the input voltage level V1 achieving the lowest gray level, gray-scale shift occurs due to the inversion of the current levels when gray-scale expression is executed by output current Io.

When conventional current supply circuit 300 shown in FIG. 21 is used to supply a display current to the light-emitting element of the current drive type, manufacturing must be done to reduce variations in characteristics of the current drive elements (typically, TFTs) in the circuit. This results in severe requirement relating to the manufacturing variations, and thus deteriorates the manufacturing yield.

Meanwhile, Japanese Patent National Publication No. 2002-514320 has disclosed, in FIG. 7, a current supply circuit, in which compensation is made for certain characteristic variations of a transistor used as a power drive element, and particularly, current variations due to threshold voltage Vth.

FIG. 23 is a circuit diagram showing a structure of a current supply circuit 400 disclosed in the above publication. Although current supply circuit 400 is provided within each pixel according to the structure of the above publication, FIG. 7 shows, as current supply circuit 400, a circuit portion functioning as a current supply circuit.

Referring to FIG. 23, current supply circuit 400 includes a capacitor 350 and switches 355 and 360 in addition to the structures of current supply circuit 300 shown in FIG. 21. Capacitor 350 is arranged between an input node Ni and a node Ng, and transmits a voltage change, which is caused on node Ni by transmission of input voltage Vin in response to the turn-on of switch 303, to node Ng by capacitive coupling.

Switch 355 is arranged between nodes Nd and Ng corresponding to the drain and gate of n-type TFT 301, respectively. Switch 360 is arranged between output node No and node Nd.

Current supply circuit 400 performs the following calibration operation to compensate for variations in output current due to variations in threshold voltage.

In the calibration operation, switch 360 is turned off, and switch 355 is turned on for accumulating electric charges corresponding the threshold voltage of n-type TFT 301 in capacitor 305. Thereby, node Ng carries a voltage equal to threshold voltage Vth of n-type TFT 301. Further, in the calibration operation, switch 303 is turned on when a reset voltage Vr is being supplied as input voltage Vin so that for the purposes of preventing noises and resetting capacitor 350, Assuming that capacitors 305 and 350 have capacitance values of C1 and C2, respectively, initial charges Q10 and Q20 accumulated in capacitors 305 and 350 in the calibration operation can be expressed by the following formulas (2) and (3), respectively:

$$Q10=C1\cdot Vth \tag{2}$$

$$Q20=C2\cdot(Vg-Vin)=C2\cdot(Vth-Vr) \tag{3}$$

In the current output operation, input voltage Vin is set corresponding to a display signal. In response to the turn-on and turn-off of switch 303, the capacitive coupling of capacitors 305 and 350 change voltage Vg on node Ng in an AC fashion. Charges Q1 and Q2, which are accumulated in capacitors 305 and 350 in the above operation, are expressed by the following formulas (4) and (5), respectively.

$$Q1=C1\cdot Vg \tag{4}$$

$$Q2=C2\cdot(Vg-Vin) \tag{5}$$

Therefore, gate voltage Vg on node Ng is expressed by the following formula (6) according to charge conservation (Q10+Q20=Q1+Q2):

$$C1\cdot Vth+C2\cdot(Vth-Vr)=C1\cdot Vg+C2\cdot(Vg-Vin)$$

$$\therefore (C1+C2)\cdot Vth-C2\cdot Vr=(C1+C2)\cdot Vg-C2\cdot Vin$$

$$\therefore Vg=Vth+C2/(C1+C2)\cdot(Vin-Vr) \tag{6}$$

By substituting gate voltage Vg obtained from the formula (6) into the formula (1), drain current Id of n-type TFT 301 and thus output current Io of current supply circuit 400 are expressed by the following formula (7):

$$Io=(\beta/2)\cdot\{C2/(C1+C2)\}^2\cdot(Vin-Vr)^2 \tag{7}$$

As can be understood from the formula (7), output current Io of current supply circuit 400 does not depend on threshold voltage Vth of the transistor (n-type TFT). Therefore, current supply circuit 400 in FIG. 23 has I-V characteristics, which are illustrated in FIG. 24 and are to be compared with those in FIG. 22.

Referring to FIG. 24, since current supply circuit 400 compensates for an error in the I-V characteristics corresponding to the variation ΔVth in threshold voltage illustrated in FIG. 22, a difference between I-V characteristic lines 310 and 320, which correspond to TFTa and TFTb, respectively, is smaller than the difference between I-V characteristic lines 310 and 320 illustrated in FIG. 22.

By using current supply circuit 400, it is possible to reduce the errors due to variations in characteristics of the transistors, and thus to produce accurately the data current for gray-scale expression.

However, as can be understood from I-V characteristics 310# and 320# illustrated in FIG. 24, compensation can be made for the variations in output current due to the variations in threshold voltage between transistors (TFTs), but compensation cannot be performed for the variations in output current due to influences, which are exerted by variations in characteristics such as mobility μ and others caused in the manufacturing process, and thus due to variations of β in the foregoing formula (1).

Therefore, according to current supply circuit 400, the variations in output current can be suppressed within a region, where gate voltage Vg is close to threshold voltage Vth, and thus a region of a small current, but the variations in output current is unavoidably large within a region of a large current. Consequently, if the number of gray levels is large, it is impossible to ignore the influence by the variations in output current within a region of high gray level (large output current), and gray-scale shift may occur.

In the structures, which employ conventional current supply circuits 300 or 400 for supplying the data current for gray-scale expression by the light-emitting elements of the current drive type, therefore, it is necessary to request severely the suppression of the characteristic variations of the transistors (TFTs) due to the manufacturing.

In particular, a low-temperature polycrystalline silicon TFT (low-temperature p-Si TFT), which is a kind of thin film transistor and can be manufactured by a low-temperature process, exhibits a higher electron mobility than amorphous silicon TFT. Therefore, a drive circuit employing the low-temperature p-Si TFTs can be formed integrally with a pixel matrix circuit on a glass substrate. Accordingly such drive circuits are being widely used in EL display devices, liquid crystal display devices and others.

However, the low-temperature polycrystalline silicon TFT is generally formed by laser anneal, and it is difficult to control uniformly a laser illumination intensity within a plane of a glass substrate. Therefore, the low-temperature p-Si TFT tends to exhibit larger manufacturing variations in transistor characteristics such as Vth (threshold voltage) and μ (mobility) than a single crystal silicon TFT. Accordingly, the display device using the low-temperature polycrystalline silicon TFTs cannot reliably have an intended data current accuracy for gray-scale expression without difficulty.

SUMMARY OF THE INVENTION

An object of the invention is to provide a display device provided with a light-emitting element of a current drive type, and particularly a structure of the display device, which accurately produces a display current for gray-scale expression without imposing an excessively load on a manufacturing process.

According to the invention, a display device for performing gray-scale expression based on a display signal of weighted n bits (n: integer larger than two), includes a plurality of pixels each having a light-emitting element of a current drive type exhibiting brightness according to a supplied current, a scanning portion periodically selecting the plurality of pixels in a predetermined manner, and a data current generating circuit supplying a data current according to the display signal to at least one of the pixels selected by the scanning portion. The data current generating circuit includes an analog current supply circuit generating an output current corresponding to an input voltage set in accordance with lower k bits (k: integer satisfying ($2 \leqq k \leqq (n-1)$)) of the display signal, and digital current supply circuits of j (j: integer equal to (n−k)) in number provided corresponding to higher j bits of the display signal, and operating to execute and stop generation of the 1st to jth bit-weighted currents corresponding to the higher j bits, respectively. The data current generating circuit supplies, as the data current, a sum of currents generated by the j digital current supply circuits and the analog current supply circuit. The output current produced by the analog current supply circuit is controlled within a range lower that the smallest one of the 1st to jth bit-weighted currents.

According to another aspect of the invention, a display device for performing gray-scale expression based on a display signal of weighted n bits (n: integer larger than two) includes a plurality of pixels each having a light-emitting element of a current drive type exhibiting brightness according to a supplied current, a scanning portion periodically selecting the plurality of pixels in a predetermined manner, and a data current generating circuit supplying a data current according to the display signal to at least one of the pixels selected by the scanning portion. The data current generating circuit includes a first analog current supply circuit generating a first output current corresponding to a first input voltage set in accordance with lower k bits (k: integer satisfying ($2 \leqq k \leqq (n-1)$)) of the display signal, and a second analog current supply circuit producing a second output current corresponding to a second input voltage set in accordance with higher j bits (j: integer equal to (n−k)) of the display signal, and supplies a sum of the first and second output currents as the data current. A range of the first output current is set on a side lower than a range of the second output current. Each of the first and second analog current supply circuits has a function of performing calibration at a predetermined point on a characteristic line representing a relationship between the input voltage and each of first and second output currents. The predetermined point is set in a range of each of the first and second output currents in the first and second analog current supply circuits.

According to still another aspect of the invention, a display device for performing gray-scale expression based on a display signal of weighted n bits (n: integer larger than two) includes a plurality of pixels each having a light-emitting element of a current drive type exhibiting brightness according to a supplied current, a scanning portion periodically selecting the plurality of pixels in a predetermined manner, and a data current generating circuit supplying a data current set to one of 1st to $2^n$th levels according to the display signal to at least one of the pixels selected by the scanning portion. The 1st to $2^n$th levels are divided in advance into current ranges of m (m: integer satisfying ($2 \leqq m < n$)) in number. The data current generating circuit includes analog current supply circuits of m in number provided corresponding to the m current ranges, respectively, and each producing an output current corresponding to an input voltage. The display device further includes a signal processing circuit applying the input voltage according to the display signal to the m analog current supply circuits. The signal processing circuit applies, in accordance with the display signal, the input signal setting the output current to one of the 1st to $2^n$th levels to the analog current supply circuit corresponding to the selected one of the m current ranges, and applies the input voltage setting the output current to zero to each of the other analog current supply circuits. Each of the m analog current supply circuits has a function of performing calibration at a predetermined point on a characteristic line representing a relationship between the input voltage and the output current, and the predetermined point in each of the m analog current supply circuits is set within corresponding one current range among the m current ranges.

Accordingly, the invention has the following major advantage. The current for executing the gray-scale expression based on the display signal of the weighted n bits (n: integer larger than two) is formed of a sum of the output currents of the one analog current supply circuit for representing the lower k bits (k: integer satisfying ($2 \leqq k \leqq (n-1)$)) and the j digital current supply circuits corresponding to the higher j bits (j: integer equal to (n−k)). Thereby, the current for the whole gray-scale range can be provided by the current supply circuits smaller in number than the bits of the display signal. Accordingly, a circuit area or footprint can be smaller than that of a structure, in which digital current supply circuits of n in number provide the current for the whole gray-scale range. Further, variations in current, which may occur in a high gray level region, i.e., in a large current region due to variations in element characteristics, can be reduced as compared with the case, in which a single analog current supply circuit generates the current for the whole gray-scale range.

The current for executing the gray-scale expression based on the display signal of the weighted n bits (n: integer larger than two) is formed of the sum of the output currents of the analog current supply circuit for representing the lower k bits (k: integer satisfying ($2 \leqq k \leqq (n-1)$)) and the analog current supply circuit for representing the higher j bits (j: integer equal to (n−k)). Thereby, the current for the whole gray-scale range can be provided by the current supply circuits smaller in number than the bits of the display signal. Accordingly, the circuit footprint can be smaller than that of the structure, in which digital current supply circuits of n in number provide the current for the whole gray-scale range. Further, variations in current, which may occur in a high gray level region, i.e., in a large current region due to variations in element characteristics, can be reduced as compared with the case, in which a single analog current supply circuit generates the current for the whole gray-scale range.

The current, which are used for the $2^n$ gray levels, and more specifically for executing the gray-scale expression based on the display signal of weighted n bits (n: integer larger than two), is generated in a sharing manner by plurality of analog current supply circuits, which are provided corresponding to the plurality of current ranges, respectively, and each have the function of performing the calibration at predetermined point in the corresponding current range. Therefore, the current for the whole gray-scale range can be provided by the current supply circuits smaller in number than the bits of the display signal. Accordingly, the circuit footprint can be smaller than that of the structure, in which only the digital current supply circuits of n in number provide the current for the whole gray-scale range. Further, variations in current, which may occur in a high gray level region, i.e., in a large current region due to variations in element characteristics, can be reduced as compared with the case, in which a single analog current supply circuit generates the current for the whole gray-scale range.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the invention will now be described with reference to the drawings. In the following description, the same or corresponding portions bear the same reference numbers.

First Embodiment (Whole Structure of Display Device)

Figure 1:
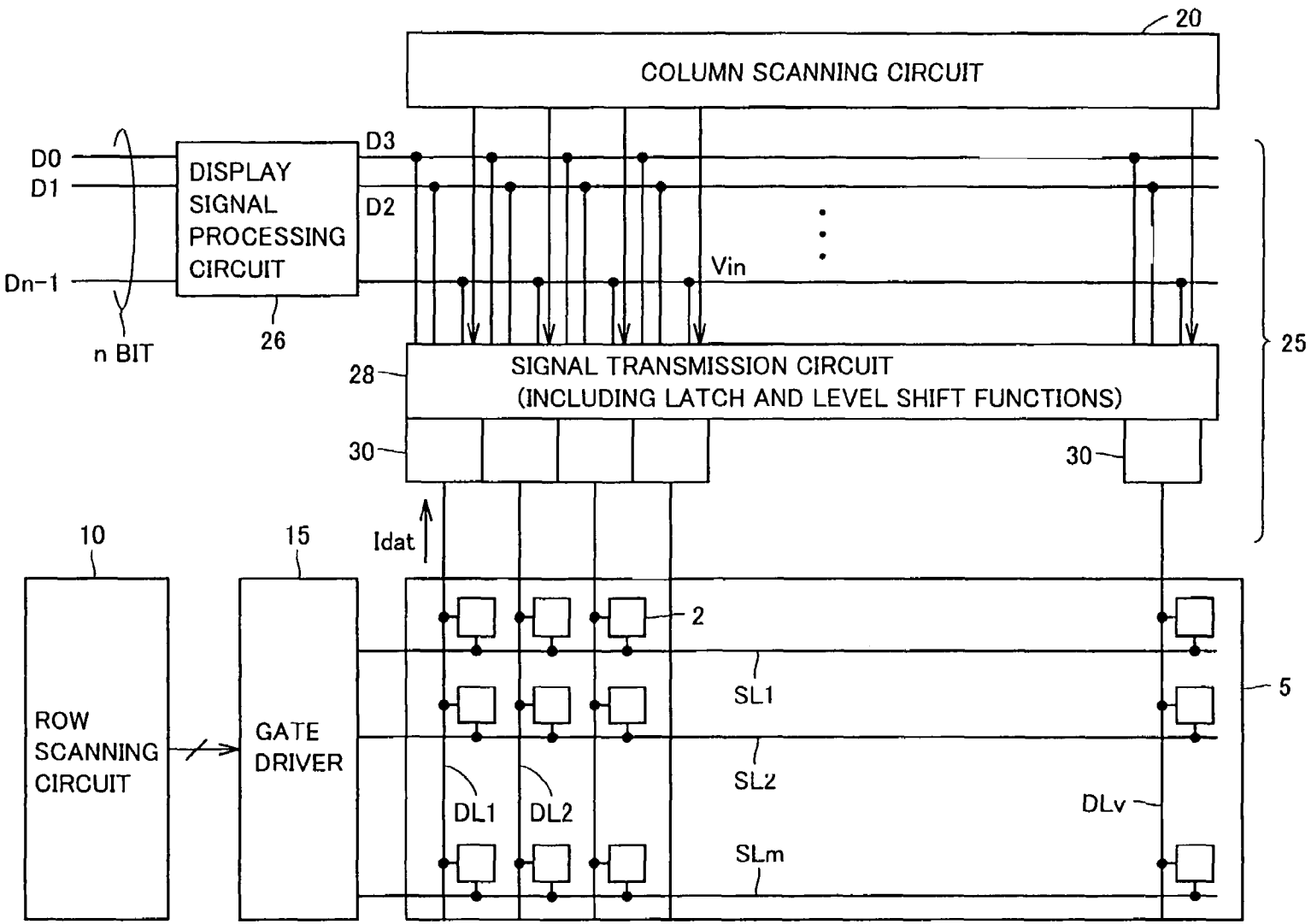
FIG. 1 is a block diagram showing by way of example a whole structure of a display device according to an embodiment of the invention.

Referring to FIG. 1, a display device 1 according to the invention includes a display panel portion 5, in which a plurality of pixels 2 are arranged in rows and columns, a row scanning circuit 10, a gate driver 15, a column scanning circuit 20 and a source driver 25.

Each pixel 2 has a light-emitting element of a current drive type such as an EL element or LED, as will be described later. In display panel portion 5 having the plurality of pixels 2 arranged in rows and columns, scanning lines SL1, SL2–SLm (m: natural number) are arranged corresponding to the rows of pixels (which may be simply referred to as "pixel rows" hereinafter), respectively, and data lines DL1, DL2–DLv (v: natural number) corresponding to the columns of pixels (which may be simply referred to as "pixel columns" hereinafter), respectively.

Row scanning circuit 10 successively selects the pixel rows at predetermined scanning cycles. Gate driver 15 successively activates scanning lines SL (generally representing scanning lines SL1–SLm) to attain the selected state in accordance with a result of selection by row scanning circuit 10. Column scanning circuit 20 successively selects the pixel columns at predetermined scanning cycles.

Source driver 25 has a display signal processing circuit 26, a signal transmitting circuit 28 and data current generating circuits 30 provided corresponding to data lines DL, respectively. Display signal processing circuit 26 receives data bits D0, D1, • • • and Dn−1 forming a display signal of n bits (n: integer larger than two), converts a part of the data bits to an analog input voltage Vin when necessary, and outputs the remaining data bits as a digital signal without conversion to an analog form).

Signal transmitting circuit 28 is arranged between display signal processing circuit 26 and each data current generating circuit 30, receives the data bits, which are output as a part of the digital signal without conversion, as well as input voltage Vin, i.e., an analog signal from display signal processing circuit 26, and transmits them to each data current generating circuit 30. Signal transmitting circuit 28 includes a latch function and a level shift function, if necessary.

Each data current generating circuit 30 generates data current Idat at levels corresponding data bits D0–Dn−1 to corresponding data lines DL, respectively.

FIG. 1 shows by way of example a structure of a display device, in which row scanning circuit 10, gate driver 15, column scanning circuit 20 and source driver 25 are formed integrally with display panel portion 5. However, these circuit portions may be arranged as external circuits with respect to display panel portion 5.

Description will now be given on a typical example of a structure of the pixel used in the display device according to the invention.

Figure 2:
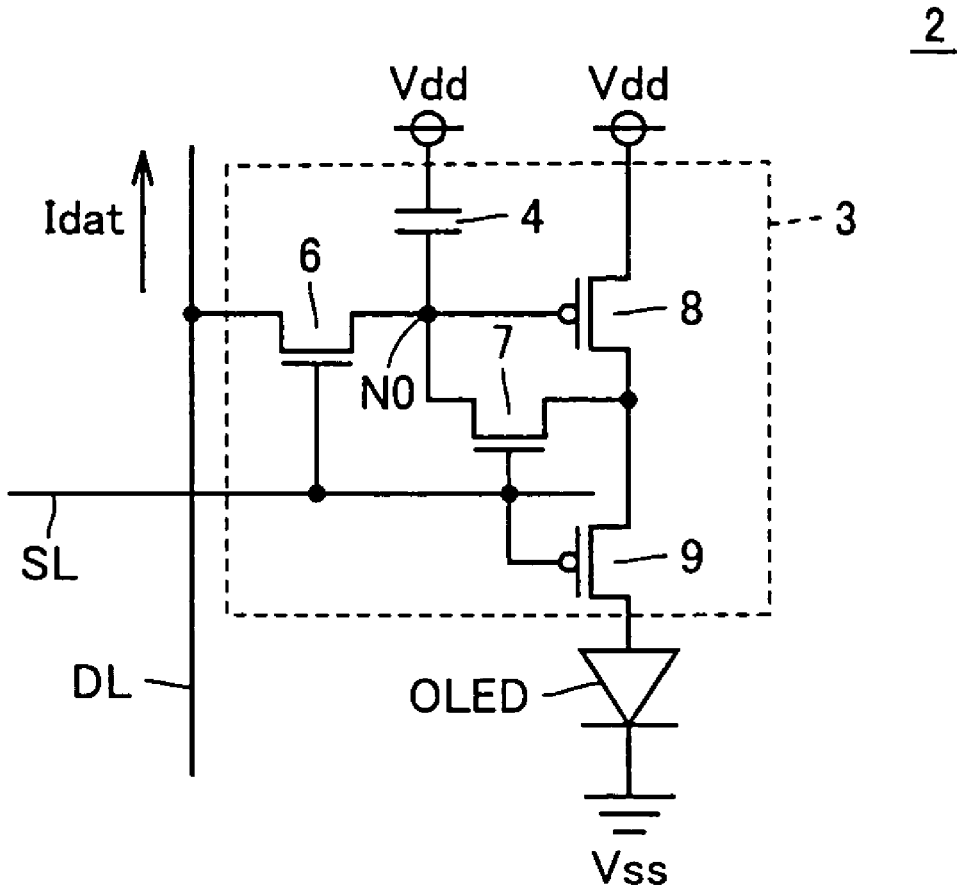
FIG. 2 is a circuit diagram showing a structure of a pixel shown in FIG. 1.

FIG. 2 shows a structure of a pixel circuit of a current program type, which employs an Organic Light-Emitting Diode (OLED) as a light-emitting element. The pixel of the current program type is disclosed, e.g., in "Pixel-Driving Methods for large-Sized Poly-Si AM-OLED Displays", Akira Yumoto et al., Asia Display/IDW'01 (2001) pp. 1395–1398.

Referring to FIG. 2, pixel 2 includes an organic light-emitting diode OLED, which is a typical example of the light-emitting element of the current drive type, and a pixel drive circuit 3 for supplying a current corresponding to data current Idat to organic light-emitting diode OLED. Pixel drive circuit 3 has a capacitor 4, n-type TFTs 6 and 7, and p-type TFTs 8 and 9.

n-type TFT 6 is electrically connected between corresponding data line DL and a node NO, and has a gate connected to corresponding scanning line SL. p-type TFTs 8 and 9 are connected in series between a power supply voltage Vdd and organic light-emitting diode OLED. n-type TFT 7 is electrically connected between a connection node, which is formed between p-type TFTs 8 and 9, and node N0. p-type TFT 8 has a gate connected to node N0. Each of gates of p-type and n-type TFTs 9 and 7 is connected to corresponding scanning line SL. Capacitor 4 is connected between node N0 and power supply voltage Vdd, and holds a voltage on node N0, i.e., a gate voltage of p-type TFT 8.

Organic light-emitting diode OLED is connected between p-type TFT 9 and a common electrode. In FIG. 2, a cathode of organic light-emitting diode OLED is connected to the common electrode to form a "cathode-common structure". The common electrode is supplied with a predetermined voltage Vss.

When scanning line SL becomes active to attain a logically high level (which will be merely referred to as an "H-level" hereinafter) achieving a selected state, the corresponding pixel operates as follows. Since n-type TFTs 6 and 7 are turned on, these form a current path extending from power supply voltage Vdd through TFTs 6–8 to data line DL. As will be described later, data current generating circuit 30 forms a 5 path for data current Idat between data line DL and predetermined voltage Vss so that data current Idat flows through the current path thus formed in pixel drive circuit 3.

In the above operation, pixel drive circuit 3 operates as follows. Since n-type TFT 7 electrically connects the drain and gate of p-type TFT 8 together, capacitor 4 holds the gate voltage, which appears when data current Idat passes through p-type TFT 8, on node N0. In this manner, pixel drive circuit 3 programs data current Idat corresponding to the display luminance during the active state of scanning line SL.

Thereafter, a target to be scanned changes, and corresponding scanning line SL is deactivated to attain the logically low level (which will be merely referred to as an "L-level" hereinafter) representing an unselected state. Thereby, n-type TFTs 6 and 7 are turned off, and p-type TFT 9 is turned on. Thereby, a current path extending from power supply voltage Vdd to the common electrode (predetermined voltage Vss) through p-type TFTs 8 and 9 as well as organic light-emitting diode OLED is formed in pixel 2. Consequently, data current Idat programmed during the active period of scanning line SL can be continuously supplied to organic light-emitting diode OLED even during the inactive state of scanning line SL so that organic light-emitting diode OLED exhibits the brightness corresponding to data current Idat.

The structure of data current generating circuit 30 will now be described in greater detail. The following description will be given on a typical example of the structure of (n=4), i.e., the structure achieving the gray-scale expression in 16 ($2^4$) gray levels based on the display signal of 4 bits formed of data bits D0–D3.

Further, currents I0–I15 represent levels of data current Idat corresponding to the 16 gradations for display, respectively. It is also assumed that differences in level between the neighboring gradations are uniform, and thus satisfy the relationships of (I0=0) and (I15–I14=I14–I13= • • • =I3–I2=I2–I1=I1–I0=I1).

(Data Current Generating Circuit Represented as an Example for Comparison)

Description will now be given on a data current generating circuit of a full digital type, which is an example for comparison with the invention.

Figure 3:
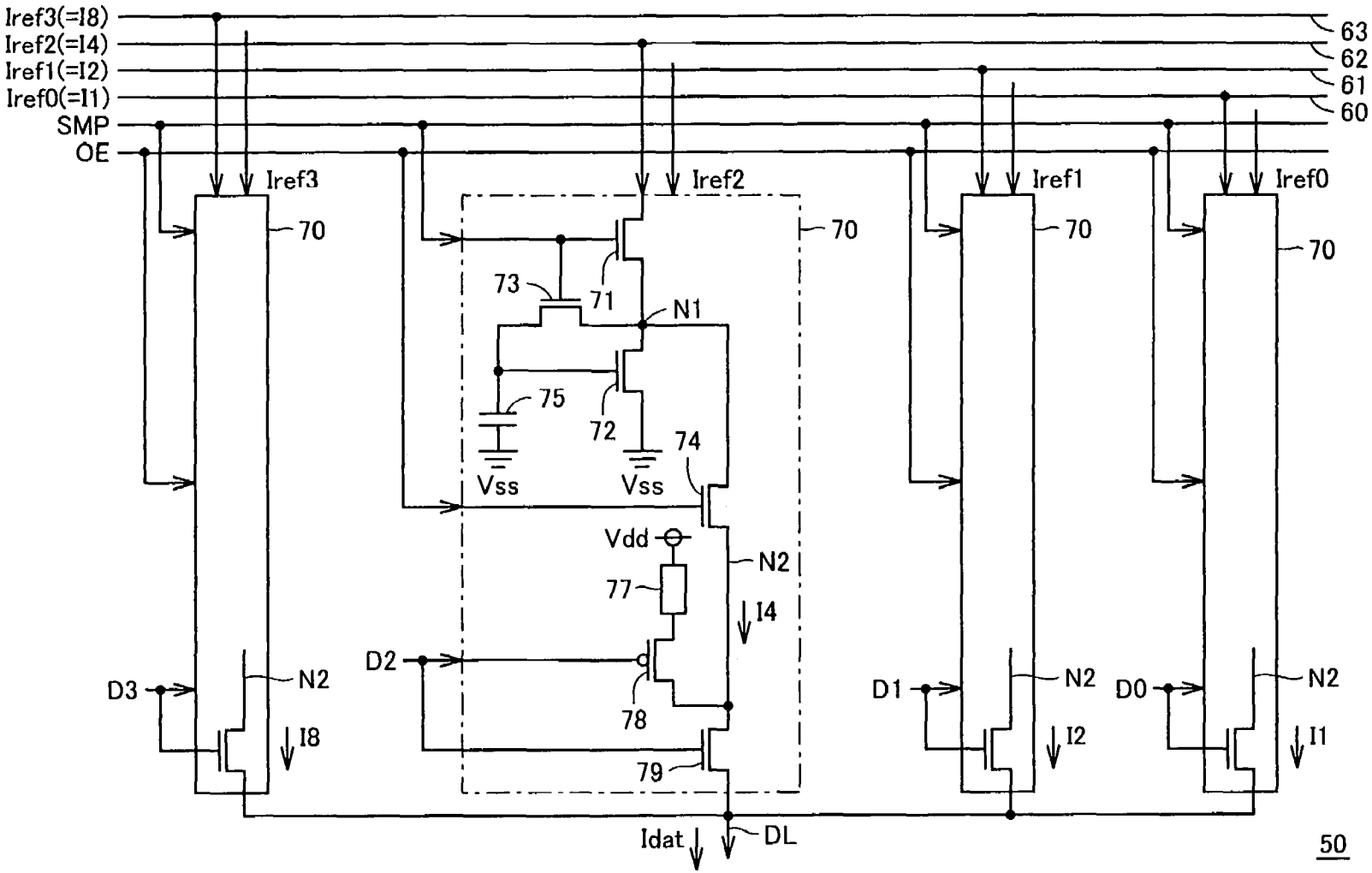
FIG. 3 is a circuit diagram showing a structure of a data current generating circuit shown as an example for comparison.

Referring to FIG. 3, a data current generating circuit 50, which is an example for comparison, has four digital current supply circuits 70 provided corresponding to data bits D0–D3, respectively.

Each digital current supply circuit 70 executes or stops the generation of the predetermined bit-weighted current in accordance with the level of the corresponding bit. The bit-weighted current is set in accordance with ratios of powers of 2 so that bit-weighted currents I1, I2, I4 and I8 correspond to data bits D0, D1, D2 and D3, respectively.

Reference current interconnections 60–63 transmit reference currents Iref0, Iref1, Iref2 and Iref3 supplied from the reference current supply circuit (not shown). Reference current Iref0 corresponds to the reference level of current I1, and reference current Iref1 corresponds to the reference level of current I2. Reference current Iref2 corresponds to the reference level of current I4, and reference current Iref3 corresponds to the reference level of current I8. Further, column scanning circuit 20 shown in FIG. 1 supplies a control signal SMP, which is set to the H-level in the calibration operation, as well as a control signal OE, which is set to the H-level in the current output operation. Respective digital current supply circuits 70 share control signals OE and SMP.

Since the digital current supply circuits 70 have the same structures, description will be representatively given on the structure of the digital current supply circuit provided corresponding to data bit D2.

Digital current supply circuit 70 has n-type TFTs 71–74, a capacitor 75 and a dummy load 77 as well as p- and n-type TFTs 78 and 79. TFTs 78 and 79 are turned on/off complimentarily to each other.

N-type TFTs 71 and 72 are connected in series between corresponding reference current interconnection 62 and predetermined voltage Vss. n-type TFT 73 is connected between a gate of n-type TFT 72 and a node N1 corresponding to the connection node between n-type TFTs 71 and 72. Thus, n-type TFT 73 is arranged between the gate and drain of n-type TFT 72. n-type TFT 74 is connected between nodes N1 and N2, and n-type TFT 79 is connected between node N2 and data line DL. Capacitor 75 is connected between the gate of n-type TFT 72 and predetermined voltage Vss, and holds the gate voltage of n-type TFT 72. Each of n-type TFTs 71 and 73 receives control signal SMP on its gate, and n-type TFT 74 receives control signal OE on its gate.

Dummy load 77 and p-type TFT 78 are connected in series between power supply voltage Vdd and node N2. Each of p-and n-type TFTs 78 and 79 receives corresponding data bit D2 on its gate.

Digital current supply circuit 70 operates as follows.

In the calibration operation, control signals SMP and OE are set to the H-and L-levels, respectively. In this operation, n-type TFTs 71 and 73 are turned on, and n-type TFT 74 is turned off. Thereby, reference current Iref2 flows through a path extending from reference current interconnection 62 through n-type TFTs 71 and 72 to predetermined voltage Vss. Further, capacitor 75 holds the gate voltage of n-type TFT 72, which appears when reference current Iref2 flows in n-type TFT 72. In the calibration operations, as described above, the gate voltage of n-type TFT 72, which can accurately generate current I4 corresponding to data bit D2, is generated and is held by capacitor 75.

Conversely, in the current output operation, control signal SMP is set to the L-level, and control signal OE is set to the H-level so that n-type TFTs 71 and 73 are turned off, and n-type TFT 74 is turned on. Consequently, a path extending from node N2 to predetermined voltage Vss through n-type TFTs 72 and 74 is formed.

When corresponding data bit D2 is "0", node N2 is isolated from data line DL, and is connected to power supply voltage Vdd via dummy load 77 in response to the turn-on of p-type TFT 78 and turn-off of n-type TFT 79. Consequently, current I4 appears on node N2, but is not supplied to data line DL.

When corresponding data bit D2 is "1", current I4 flows through a path, which extends from data line DL to predetermined voltage Vss through node N2, n-type TFT 74, node N1 and n-type TFT 72, in response to the turn-off of p-type TFT 78 and the turn-on of n-type TFT 79. Thus, n-type TFTs 74 and 79 isolate data line DL from internal node Ni in the calibration operation, and connect them together in accordance with corresponding data bit D2 in the current output operation.

As described above, the gate voltage of n-type TFT 72 is controlled or adjusted in advance based on reference current Iref2 in the calibration operation. Therefore, even if there are variations in characteristics of n-type TFT 72, i.e., the current drive element, current I4 can be accurately supplied in the current output operation.

Even when corresponding data bit is "0", dummy load 77 and p-type TFT 78 can pass a current through n-type TFT 72. Thereby, even when an operation is performed to stop the generation of the current for data line DL, it is possible to prevent lowering of the voltage held by capacitor 75. In other words, if a current path including n-type TFT 72 is not formed when corresponding data bit is "0", a drain potential of n-type TFT 72 lowers, and the charges held by capacitor 75 leak through n-type TFTs 72 and 73. Thereby, an amount of current supplied by n-type TFT 72 changes from the level of reference current Iref2, which adversely affects an accuracy of the output current.

Digital current supply circuits 70, which are provided corresponding to other data bits D0, D1 and D3, respectively, have substantially the same structures, and operate to execute or stop the supply of the corresponding bit-weighted currents, i.e., currents I1, I2 and I8 to data lines DL.

Since the output node of each digital current supply circuit 70 is connected to data line DL, a sum of the output currents, which are provided from digital current supply circuits 70 corresponding to data bits D0–D3, respectively, flows as data current Idat to data line DL. Consequently, for the display signal of 4 bits, data current Idat supplied to data line DL can be set to 16 levels of currents I0–I15 corresponding to the 16 levels of ((D0, D1, D2, D3)=(0, 0, 0, 0), • • • (1, 1, 1, 1)).

According to data current supply circuit 50 shown in FIG. 3, as described above, digital current supply circuits 70, which can perform the calibration operation in response to control signal SMP, generates currents I1, I2, I4 and I8, i.e., the bit-weighted currents corresponding to data bits D0–D3, respectively. The sum of these output currents of digital current supply circuits 70 can be supplied as data current Idat so that data current Idat can be accurately generated for performing the gray-scale expression.

However, the above manner requires digital current supply circuits 70 equal in number to the data bits of the display signal so that an area of the data current generating circuit increases. In particular, the above disadvantage is remarkable in the structure, which includes data current generating circuits corresponding to respective data lines DL as shown in FIG. 1.

Structure of Data Current Generating Circuit According to First Embodiment

Description will now be given on a structure of a data current generating circuit, in which the digital and analog current supply circuits already described are combined to suppress increase in circuit footprint and to ensure an intended data current accuracy.

Figure 4:
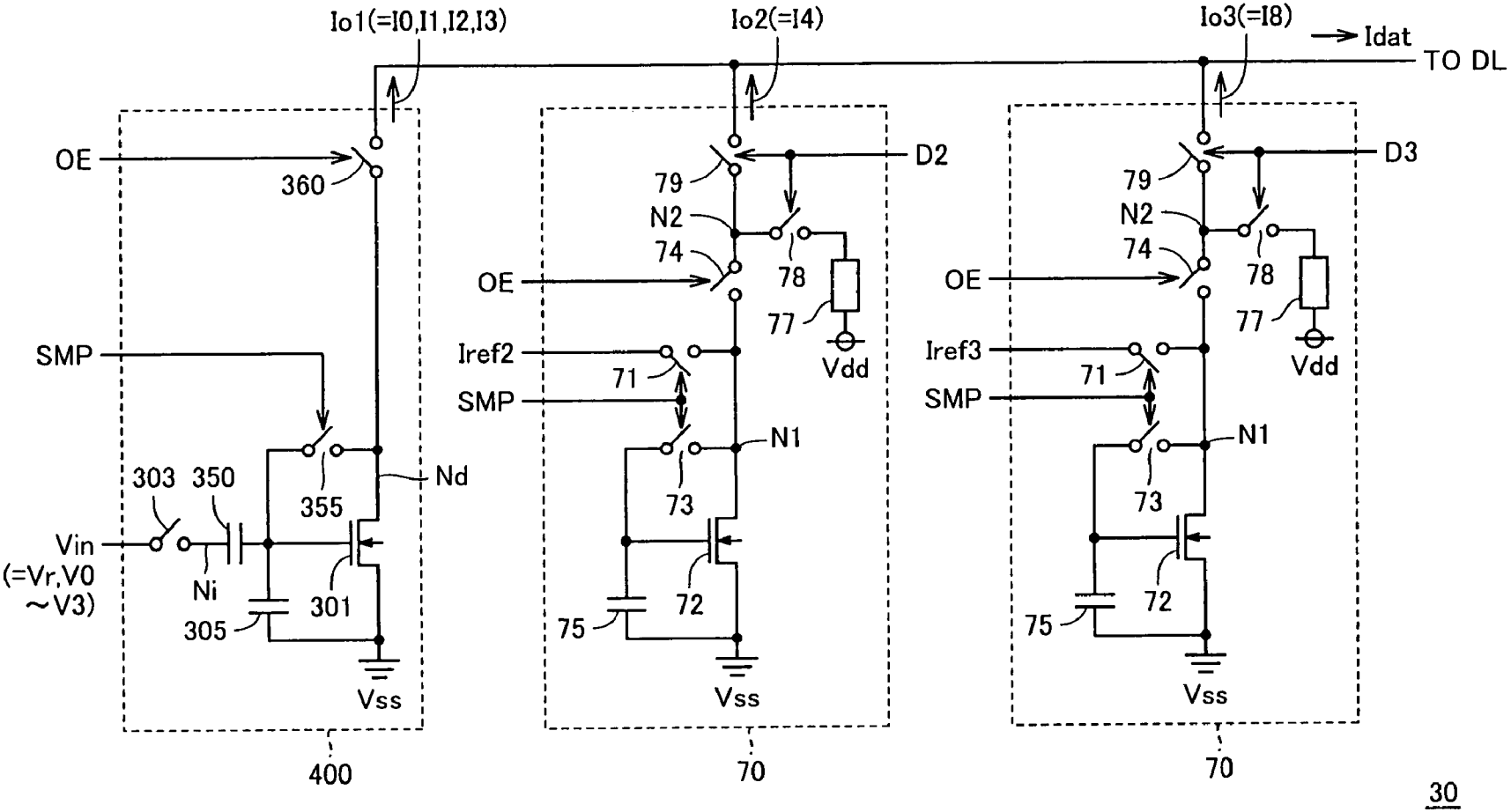
FIG. 4 is a circuit diagram showing a structure of a data current generating circuit according to a first embodiment of the invention.

Referring to FIG. 4, data current generating circuit 30 according to the first embodiment includes one analog current supply circuit 400 provided for lower data bits D0 and D1, and two digital current supply circuits 70 provided corresponding to higher data bits D2 and D3, respectively. Each of analog and digital current supply circuits 400 and 70 has the same structure as those already described with reference to FIGS. 23 and 3, and therefore description thereof is not repeated. In FIG. 4, however, TFTs performing the turn-on and turn-off operations in digital current supply circuits 70 bear the same reference numbers, and are represented as switch elements.

Analog current supply circuit 400 likewise executes the calibration operation and the current output operation in response to control signals SMP and OE shared by the respective digital current supply circuits 70.

Analog current supply circuit 400 is supplied with input voltage Vin corresponding to lower data bits D0 and D1 from display signal processing circuit 26 shown in FIG. 1. More specifically, it is assumed that input voltage Vin is set to V0, V1, V2 and V3 for lower data bits D0 and D1, and more specifically, corresponding to the cases of (D0, D1)=(0, 0), (0, 1), (1, 0) and (1, 1), respectively. Based on the formula (7), voltages V1, V2 and V3 are determined in view of reset voltage Vr to levels, which make the drain current of n-type TFT 301 and thus an output current Io1 of analog current supply circuit 400 equal to currents I1,I2 and 13, respectively. Likewise, it is assumed that voltages V4–V15 provide the input voltage levels making the output currents of the analog current supply circuit equal to currents I4–I15, respectively. Voltage V0 is set to the level, which turns off n-type TFT 301.

Digital current supply circuit 70 provided corresponding to higher data bit D2 provides an output current Io2 (=I4) when data bit D2 is "1", and stops the generation of the output current (i.e., sets Io2 to 0) when data bit D2 is "0". Likewise, digital current supply circuit 70 provided corresponding to higher data bit D3 provides an output current Io3 (=I8) when data bit D3 is "1", and stops the generation of the output current (i.e., sets Io3 to 0) when data bit D3 is "0".

Output nodes of analog current supply circuit 400 and two digital current supply circuits 70 are electrically connected together, and are further connected to data line DL. Consequently, a sum (Io1+Io2+Io3) of output current Io1 of analog current supply circuit 400 and output currents Io2 and Io3 of digital current supply circuits 70 is supplied as data current Idat to data line DL.

Figure 5:
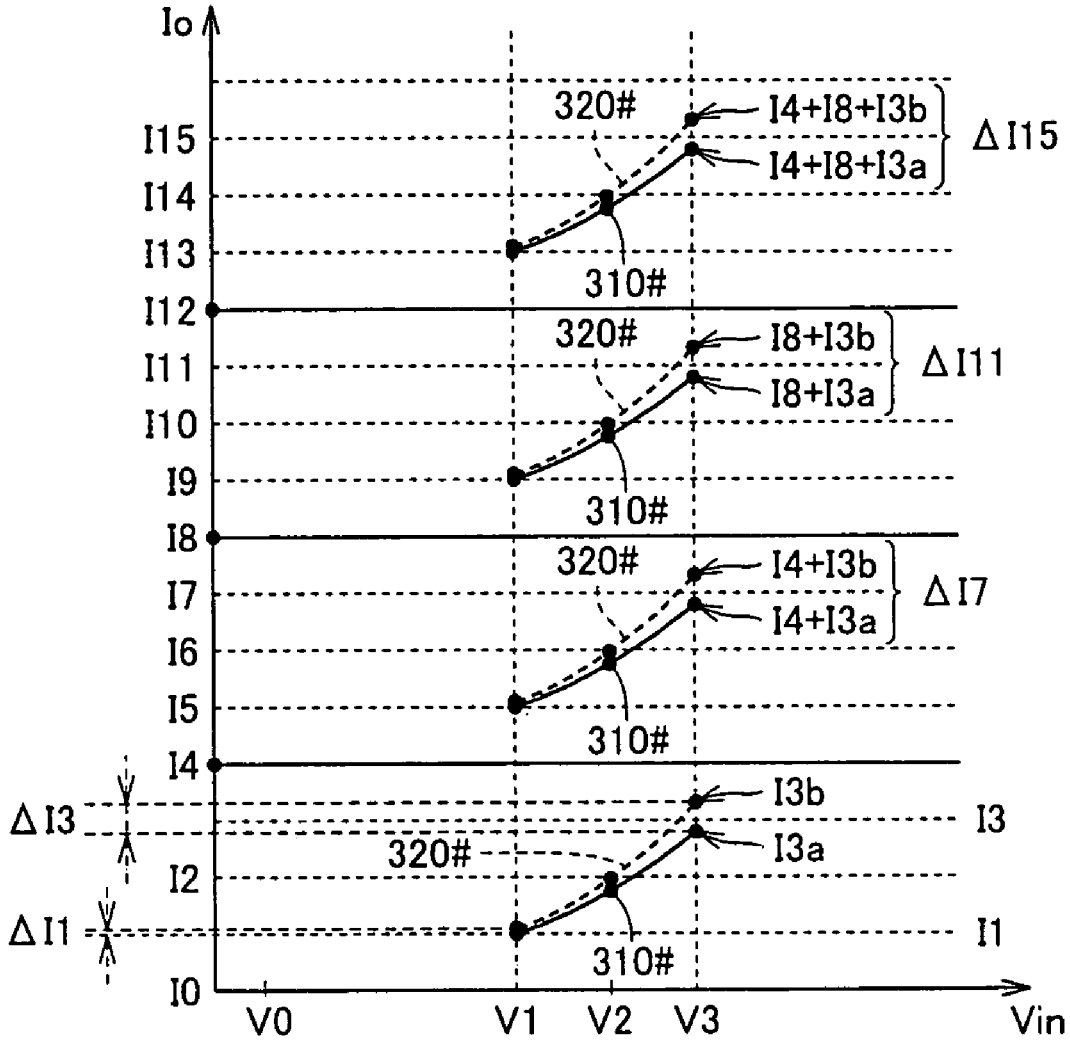
FIG. 5 illustrates variations in output current of the data current generating circuit according to the first embodiment.

FIG. 5 illustrates variations in data current Idat, i.e., the output current of the data current generating circuit according to the first embodiment.

Figure 22:
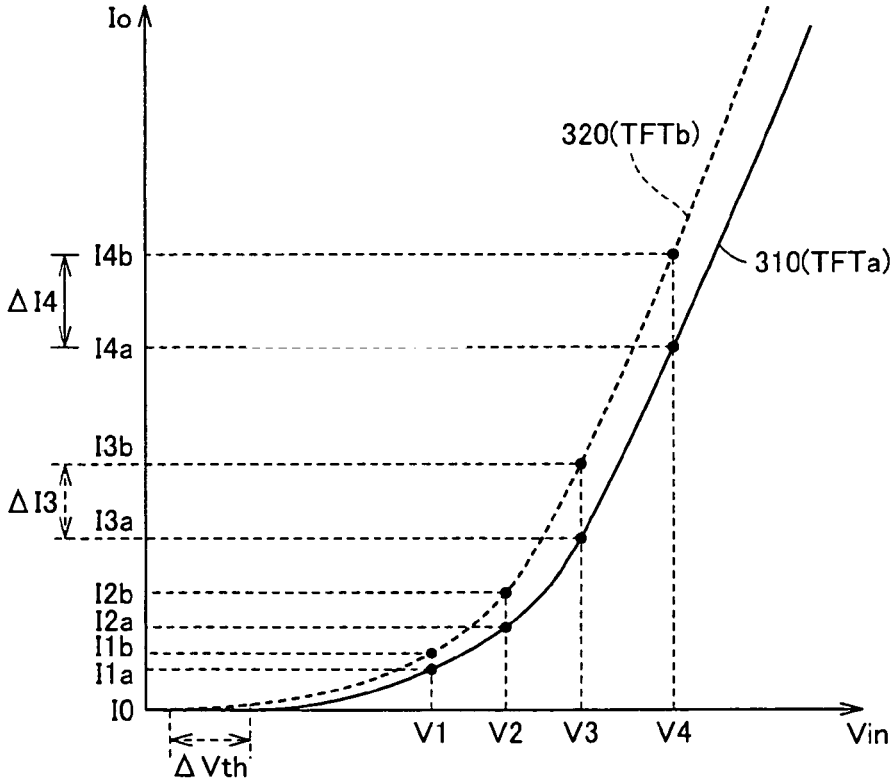
FIG.22 PRIOR ART
FIG. 22 illustrates a relationship between an input voltage and an output current of the current supply circuit shown in FIG. 21.

Referring to FIG. 5, variations similar to those already described with reference to FIG. 22 occur in output current Io1 of analog current supply circuit 400 in accordance with the transistor characteristics of n-type TFT 301, i.e., the current drive element. Therefore, in a range of data current Idat from I1 to I3, current variations ΔI1–ΔI3 occur similarly to conventional analog current supply circuit 400. As already described, however, the calibration operation compensates for the threshold voltage of n-type TFT 301. Therefore, current variations ΔI1–ΔI3 in the control range of output current Io1 are relatively small.

Within the range of data current Idat from I4 to I15, data current Idat of I4, I8 and I12 is achieved only by the sum of output currents Io2 and Io3 of digital current supply circuit 70, and in this case, the calibration function of digital current supply circuit 70 can nearly eliminate the current variations due to the transistor characteristics.

In the cases where data current Idat is in ranges of I5–I7, I9–I11 and I13–I15 respectively, data current Idat is supplied by the sum of output current Io1 of analog current supply circuit 400 and output currents Io2 and Io3 of digital current supply circuits 70 containing no current variations.

In the cases where data current Idat is equal to I5, I9 and I13, respectively, only current variations ΔI1 occur in analog current supply circuit 400. Likewise, in the cases where data current Idat is I6, I10 and I14, respectively, only current variations ΔI2 occur in analog current supply circuit 400. In the cases where data current Idat is I7, I11 and I15, respectively, only current variations ΔI3 occur in analog current supply circuit 400. Thus, the maximum value of variations in data current Idat of whole currents I0–I15 provided for 16 gradations is suppressed to current variations ΔI3 (=I3*a*–I3*b*) in current I3 for the low gray level.

Figure 23:
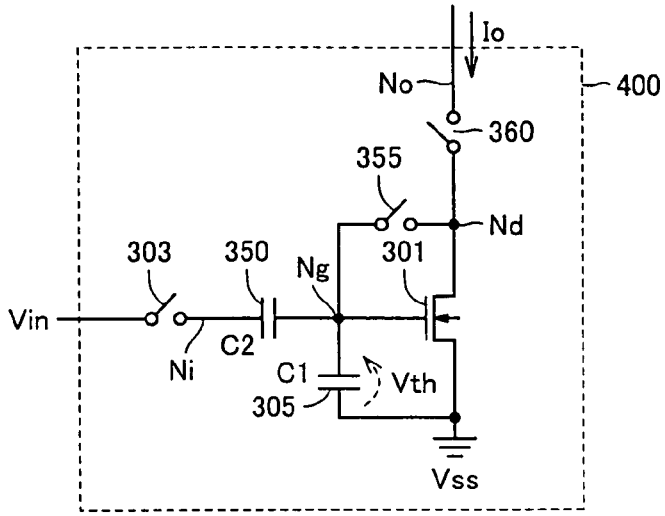
FIG.23 PRIOR ART
FIG. 23 is a circuit diagram showing a structure of a conventional current supply circuit, in which compensation is made for variations in threshold voltage.

According to the structure of the data current supply circuit of the first embodiment, as described above, it is possible to reduce the current variations in a region of high gray level, i.e., in a region of large data current Idat as compared with the case where conventional current supply circuit 400 produces the whole gray-scale range of the data current as described in FIG. 23. Further, as compared with data current generating circuit 50 of the example for comparison shown in FIG. 3, the current variations are slightly large, but the number of the required current supply circuits is smaller than the number of data bits of the display signal so that the circuit footprint can be reduced.

The variations in output current of the data current generating circuit according to the first embodiment will now be discussed qualitatively.

In connection with current I3, the following formula (8) is established according to the characteristics of conventional analog current supply circuit 400.

$$I3=(\beta/2)\cdot\{C2/(C1+C2)\}^2\cdot(V3-Vr)^2 \quad (8)$$

Assuming that variations Δβ occur in a current coefficient β of n-type TFTs provided as the current drive elements in the whole display device, variations ΔI3 in current I3 for the third gray level is expressed by the following formula (9):

$$\Delta I3=(\Delta\beta/2)\cdot\{C2/(C1+C2)\}^2\cdot(V3-Vr)^2 \quad (9)$$

Unevenness of display occurs due to the relationship between the maximum current variations ΔI3 of analog current supply circuit 400 and current value I1 of the first gray level (LSB). Thus, a relationship of (ΔI3<I1) is required for preventing gray-scale inversion in the display device. Since I3 is equal to (3×I1), the conditions for preventing the gradation inversion are expressed by the following formula (10):

$$\Delta I3<I3/3$$

$$\therefore \Delta\beta/\beta<33.3\% \quad (10)$$

Thus, in the data current generating circuit according to the first embodiment, 16 gray levels can be performed by reducing the variations in current coefficient β, which occur due to the manufacturing process, to 33.3% or lower in connection with the TFT used as the current drive element.

In contrast to this, the structure, which produces data current Idat for 16 gradations by analog current supply circuit 400 alone, must satisfy a relationship of (ΔI15<I1) in connection with current I15 at the highest gray level. Consequently, more severe conditions represented by the following formula (11) must be satisfied for preventing the gradation inversion.

$$\Delta I15<I15/15$$

$$\therefore \Delta\beta/\beta<6.7\% \quad (11)$$

Therefore, by employing the data current generating circuit according to the first embodiment, it is possible to increase relatively the allowable variations in transistor characteristics at the time of manufacturing of the current drive elements (TFTs). This relieves requirements on the accuracy of the manufacturing process so that improvement of the manufacturing yield can be expected.

Second Embodiment

Description will now be given on embodiments relating to several forms of the structure of data current generating circuit 30 shown in FIG. 1. In the embodiments described below, data current generating circuit 30 in the display device of the invention shown in FIG. 1 is replaced with data current generating circuits of second and further embodiments, respectively.

Figure 6:
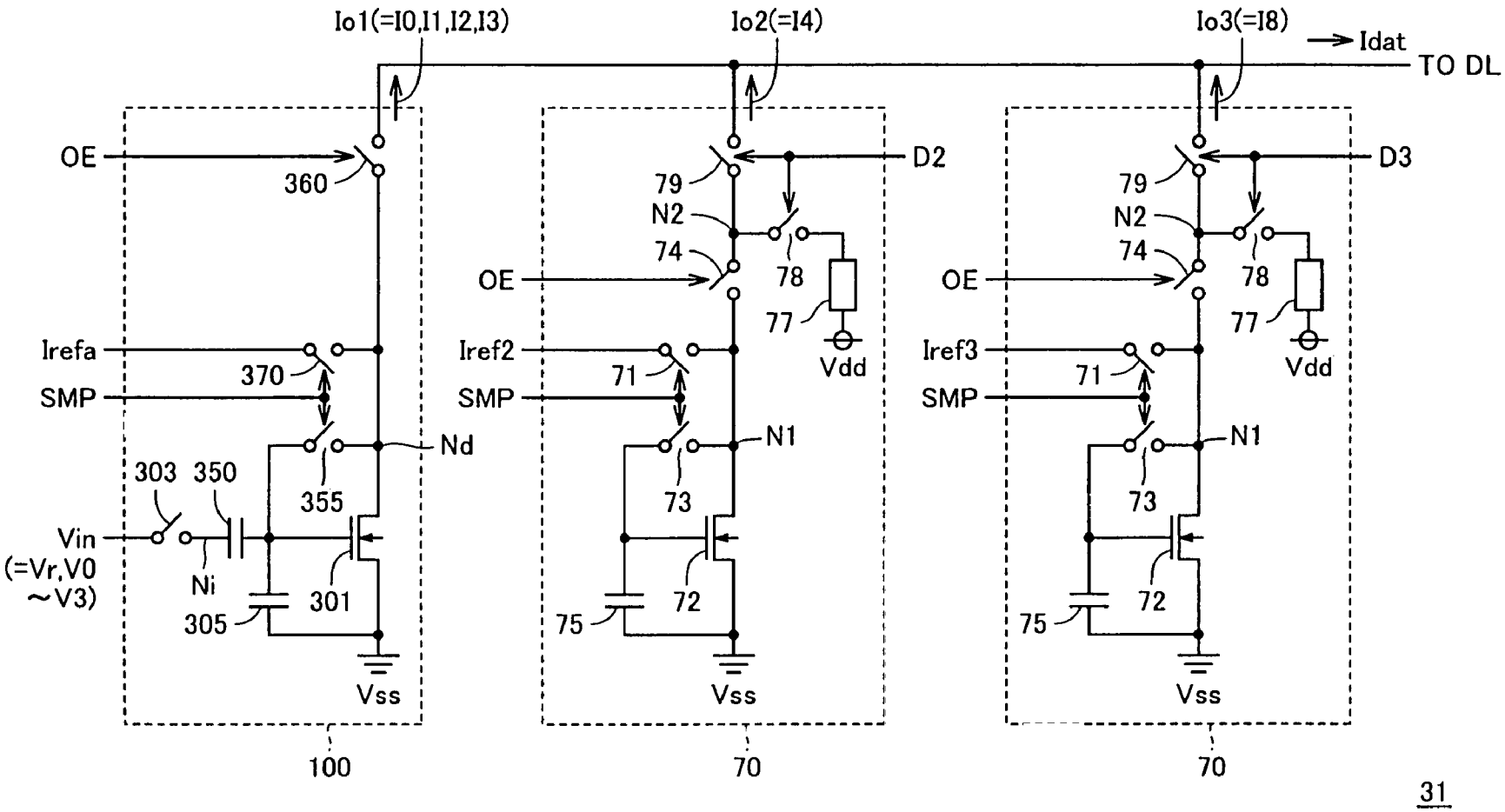
FIG. 6 is a circuit diagram showing a structure of a data current generating circuit according to a second embodiment of the invention.

Referring to FIG. 6, a data current generating circuit 31 according to a second embodiment differs from data current generating circuit 30 of the first embodiment in that analog current supply circuit 400 is replaced with an analog current supply circuit 100.

Similarly to data current supply circuit 30, digital current supply circuits 70 are provided corresponding to data bits D2 and D3, respectively, and operate to execute or stop the production of bit-weighted currents, i.e., currents I4 and I8 in response to the levels of data bits D2 and D3, respectively.

Analog current supply circuit 100 selectively produces currents I0–I3 in response to lower data bits D0 and D1 similarly to analog current supply circuit 400 shown in FIG.

400, but differs from analog current supply circuit 400 in calibration function of output current Io1.

First, a circuit structure and an operation of the circuit structure of analog current supply circuit 100 will be described in greater detail.

Analog current supply circuit 100 further differs from analog current supply circuit 400 in that a reference current switch 370 is employed. In the calibration operation, reference current switch 370 is turned on in response to control signal SMP, and thereby supplies a reference current Irefa produced by a reference current supply (not shown) to a node Nd. Reference current switch 370 is turned off in the current output operation. Structures other than the above are substantially the same as those of analog current supply circuit 400, and therefore description thereof is not repeated.

In the calibration operation of analog current supply circuit 100, a switch 360 is turned on, and a switch 355 is turned off. Thereby, reference current Irefa passes through n-type TFT 301, and a capacitor 305 accumulates a gate voltage required for supplying reference current Irefa to node Nd. Thereby, a reference voltage Vref is placed on node Ng. In the calibration operation, reset voltage Vr is applied as input voltage Vin, and switch 303 is turned on for preventing noises and resetting a capacitor 350.

Therefore, initial charges Q10 and Q20, which are accumulated in capacitors 305 and 350 in the calibration operation, are expressed by the following formulas (12) and (13), respectively. In the following formulas, it is assumed that capacitors 305 and 350 have capacitance values C1 and C2 similarly to current supply circuit 400, respectively.

$$Q10=C1\cdot Vref \tag{13}$$

$$Q20=C2\cdot(Vg-Vin)=C2\cdot(Vref-Vr) \tag{14}$$

In the current output operation, an operation similar to that of current supply circuit 400 is performed to turn on switches 303 and 360, and to turn off switches 355 and 370. Therefore, charges Q1 and Q2 accumulated in capacitors 305 and 350 are expressed by the following formulas (14) and (15), respectively.

$$Q1=C1\cdot Vg$$

$$Q2=C2\cdot(Vg-Vin) \tag{15}$$

Therefore, according to the charge conservation (Q10+Q20=Q1+Q2), voltage Vg on node Ng, i.e., gate voltage Vg of the n-type TFT is expressed by the following formula (16):

$$C1\cdot Vref+C2\cdot(Vref-Vr)=C1\cdot Vg+C2\cdot(Vg-Vin)$$

$$\therefore (C1+C2)\cdot Vref-C2\cdot Vr=(C1+C2)\cdot Vg-C2\cdot Vin$$

$$\therefore Vg=Vref+C2/(C1+C2)\cdot(Vin-Vr) \tag{16}$$

By substituting gate voltage Vg obtained from formula (16) into the foregoing formula (1), drain current Id of n-type TFT 301, i.e., output current Io of current supply circuit 400 is expressed by the following formula (17).

$$Io=(\beta/2)\cdot\{C2/(C1+C2)\cdot(Vin-Vr)+(Vref-Vth)\}^2 \tag{17}$$

Figure 7:
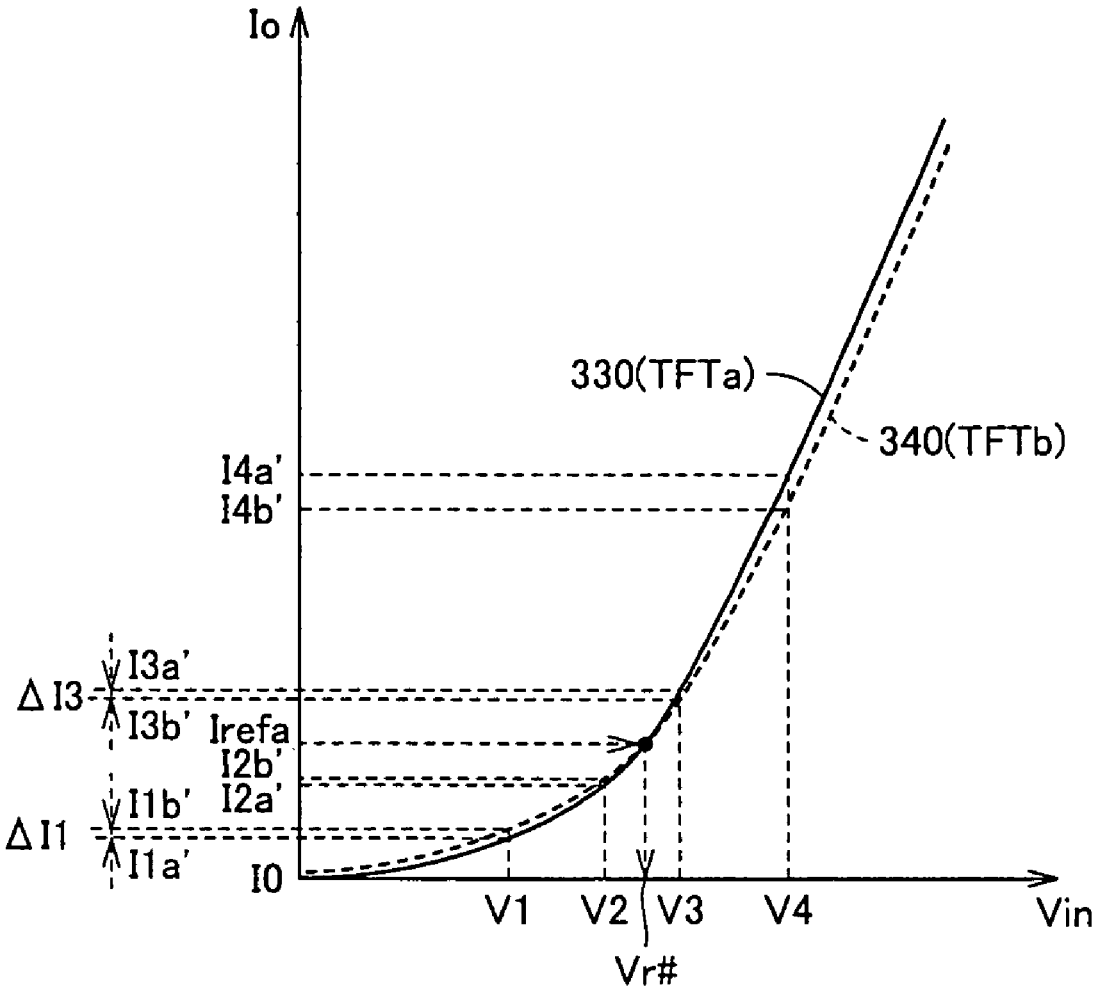
FIG. 7 illustrates a relationship between of an input voltage and an output current of an analog current generating circuit shown in FIG. 6.

Consequently, a relationship between input voltage Vin and output current Io of analog current supply circuit 100 are achieved as illustrated in FIG. 7.

Figure 24:
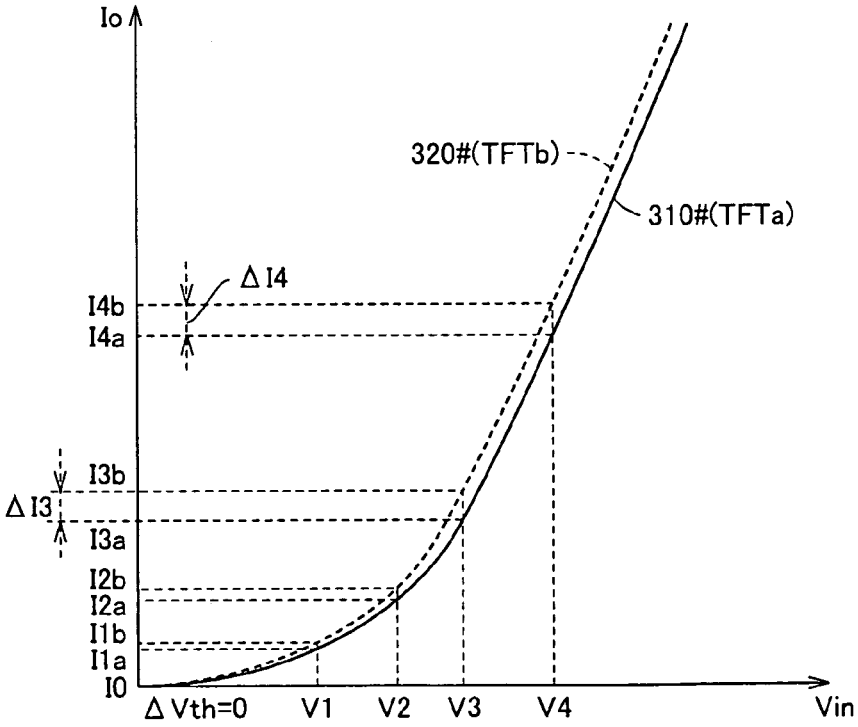
FIG.24 PRIOR ART
FIG. 24 illustrates a relationship between an input voltage and an output current of the current supply circuit shown in FIG. 23.

FIG. 7 illustrates I-V characteristic lines 330 and 340 of analog current supply circuit 100, which are exhibited by employing two TFTs (TFTa and TFTb) having different characteristics as n-type TFTs 301 in FIG. 6, respectively, similarly to FIG. 24 illustrating the characteristics of analog current supply circuit 400.

As can be understood from comparison between FIGS. 7 and 24, analog current supply circuit 100 calibrates the relationship between input voltage Vin and output current Io at one point corresponding to reference current Irefa on the I-V characteristic line. Thus, when reference current Irefa is output, an influence by characteristic variations of the current drive element (n-type TFT 301) in the analog current supply circuit is eliminated so that variations in output currents of the respective analog current supply circuits can be prevented. In FIG. 7, "Vr#" represents the level of input voltage Vin, which provides voltage Vg equal to reference voltage Vref on node Ng.

In a range of the output current larger or smaller than reference voltage Vrefa, a difference occurs between characteristic lines 330 and 340 in accordance with a difference between reference current Irefa and the output current, and a difference depending on the characteristic variations of the current drive elements (TFTs) occurs between output currents Io.

In data current generating circuit 31 according to the second embodiment, analog current supply circuit 100 produces currents I0–I3 corresponding to lower data bits D0 and D1. In this operation, reference current Irefa is set to the level intermediate between currents I0–I3 so that the maximum value of the variations in output currents can be reduced. From the comparison between FIGS. 7 and 23, it can be seen that current variation ΔI1 corresponding to current I1 provided by analog current supply circuit 400 (|I1*a*–I1*b*|in FIG. 24) is smaller than that of analog current supply circuit 100 (|I1*a*'–I1*b*'|in FIG. 7), but the difference between them is not important because originally current I1 is small.

In connection with current variation ΔI3 in current I3, which causes the maximum variation in analog current supply circuit 400, current variation ΔI3 (|I3*a*'–I3*b*'|) in analog current supply circuit 100 is smaller than current variation ΔI3 (|I3*b*–I3*a*|in FIG. 24) of analog current supply circuit 400. Therefore, the maximum value of the output current variations in the range of currents I0–I3 of analog current supply circuit 100 is smaller than that of analog current supply circuit 400.

Figure 8:
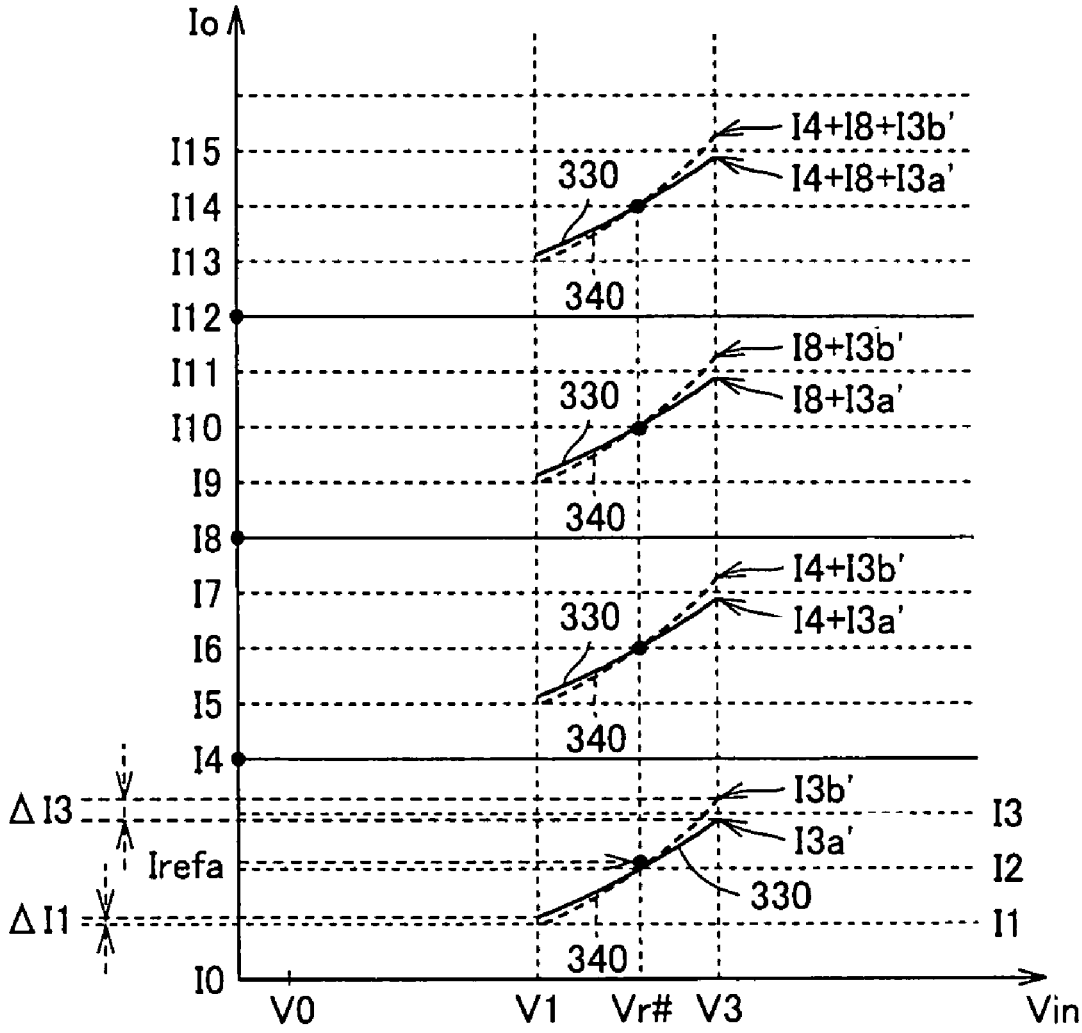
FIG. 8 illustrates variations in output current of a data current generating circuit according to the second embodiment.

FIG. 8 illustrates variations of the output current of the data current generating circuit according to the second embodiment.

Referring to FIG. 8, current variations are calibrated in reference current Irefa, which is set to a level (e.g., of current I2) intermediate between currents I1–I3. Therefore, variations ΔI1 and ΔI3 respectively corresponding to currents II and 13 are nearly equal to each other.

As illustrated in FIG. 8, therefore, the differences between transistor characteristics cause the largest current variations when currents I3, I7, I11 and I15 are output. In the operation of outputting such currents I3, I7, I11 and I15, current variations ΔI3 (=(|I3*a*'–I3*b*'|)) caused by analog current supply circuits 400, which employ the current drive elements formed of the TFTs of different characteristics, are suppressed as compared with the current variations ΔI3 (=(|I3*a*–I3*b*|) in FIG. 5) in the data current generating circuit according to the first embodiment.

Therefore, the data current generating circuit according to the second embodiment can reduce the circuit footprint similarly to the first embodiment, and further can generate data current Idat for gray-scale expression with further accuracy. This further increases the allowable variations in transistor characteristics at the time of manufacturing of the current drive elements (TFTs). Consequently, further improvement of the manufacturing yield can be expected.

Third Embodiment

Figure 9:
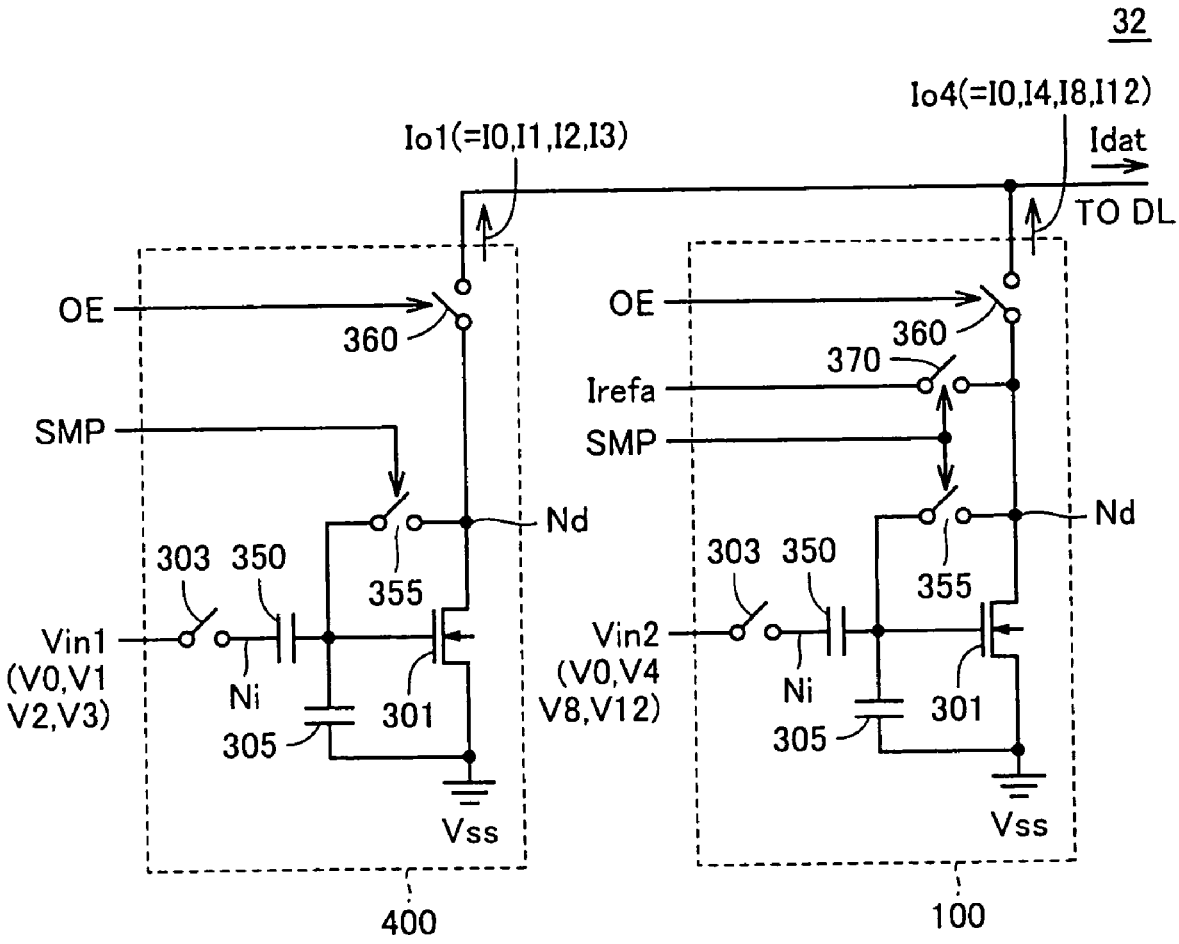
FIG. 9 is a circuit diagram showing a structure of a data current generating circuit according to a third embodiment of the invention.

Referring to FIG. 9, a data current generating circuit 32 according to a third embodiment includes one analog current supply circuit 100 and one analog current supply circuit 400. The structures of analog current supply circuits 100 and 400 are the same as those already described, and therefore description thereof is not repeated.

Analog current supply circuit 400 is supplied with input voltage Vin1 having one of levels of voltages V0–V3 corresponding to currents I0–I3, respectively. Analog current supply circuit 100 is supplied with input voltage Vin2 set to one of voltages V0, V4, V8 and V12 corresponding to currents I0, I4, I8 and I12, respectively.

Input voltage Vin1 is produced in accordance with lower data bits D0 and D1 by display signal processing circuit 26 shown in FIG. 1, similarly to input voltage Vin in the first and second embodiments. Input voltage Vin2 is produced in accordance with higher data bits D2 and D3 by display signal processing circuit 26. More specifically, in the cases of ((D2, D3)=(0, 0), (0, 1), (1, 0) and (1, 1)), input voltage Vin2 is set to V0, V4, V8 and V12, respectively.

Since the output nodes of analog current supply circuits 100 and 400 are connected to corresponding data line DL, a sum of output currents Io1 and Io4 of analog current supply circuits 400 and 100 is supplied as data current Idat to data line DL.

Figure 10:
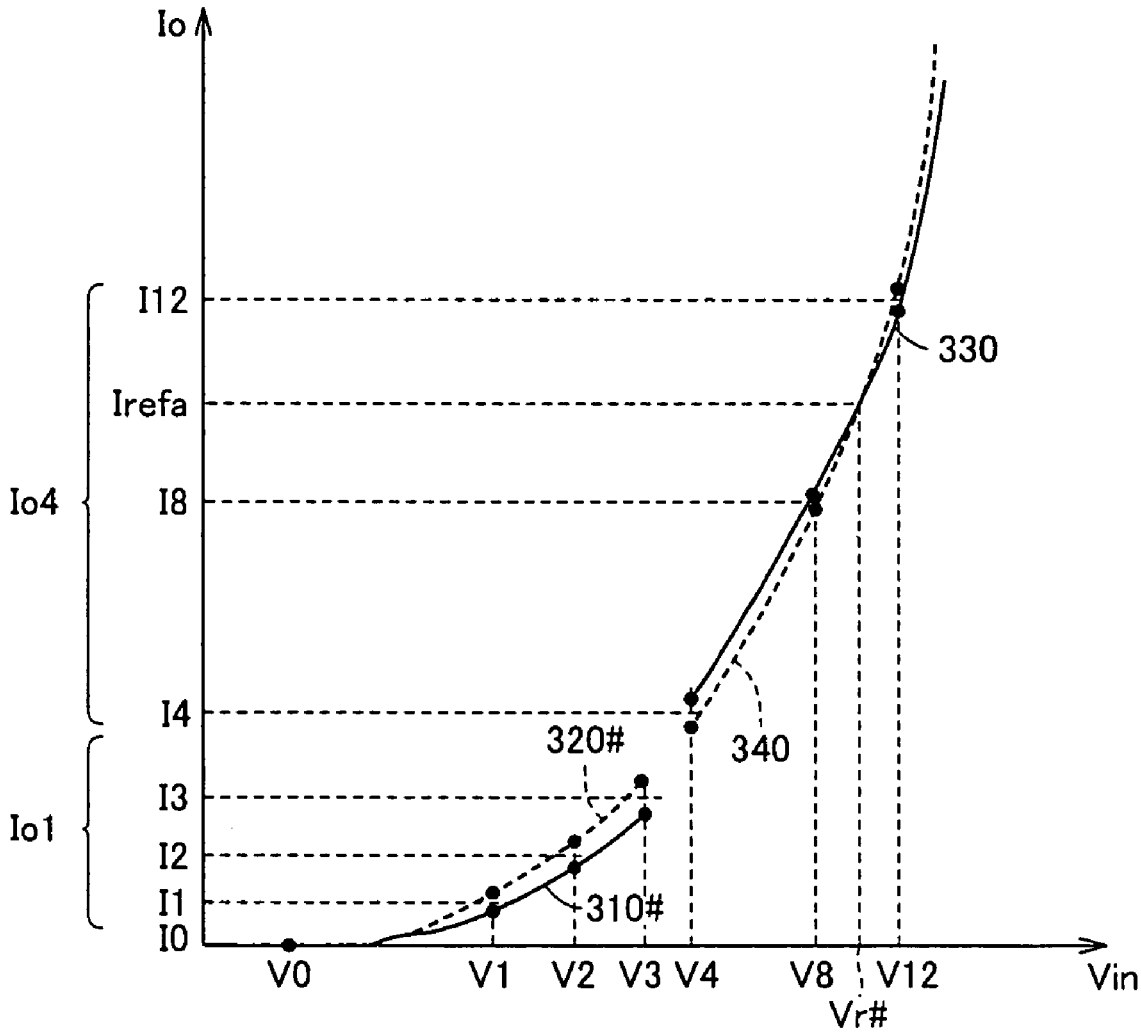
FIG. 10 illustrates variations in output current of a data current generating circuit according to the third embodiment.

FIG. 10 illustrates variations in output current of the data current generating circuit according to the third embodiment.

Referring to FIG. 10, current Io1 is generated by analog current supply circuit 400 in accordance with characteristic lines 310# and 320# by compensating for variations in threshold voltage of the TFTs (i.e., current drive elements), similarly to the manner already described with reference to FIG. 5. Therefore, current variations similar to those in FIG. 5 occur in currents I1, I2 and I3 due to characteristic differences of transistors.

Current Io4 produced by analog current supply circuit 100 is produced in accordance with characteristic lines 330 and 340 already described with respect to FIG. 7. Thus, by setting reference current Irefa to the level intermediate between currents I4 and I12, it is possible to suppress the maximum value of current variations ΔI4, ΔI8 and ΔI12 in currents I4, I8 and I12.

As described above, currents I0–I15 of 16 gray levels can be produced as data current Idat from a sum of current Io1 (=I0, I1, I2, I3) produced by analog current supply circuit 400 and current Io4 (=I0, I4, I8, I12) produced by analog current supply circuit 100.

According to the data current generating circuit of the third embodiment, since two analog current supply circuits 100 and 400 can generate the whole gradation range of data current Idat, the circuit footprint can be further reduced.

In connection with the variations in data current Idat, the variations in output currents can be suppressed in the high gray level region, as compared with at least such a case that analog current supply circuit 100 or 400 is used alone, although data current generating circuit 50 of the digital type, which has been described as an example for comparison, can suppress such variations further effectively. Similarly to the first and second embodiments, therefore, it is possible to ensure large allowable variations in transistor characteristics at the time of manufacturing of the current drive elements (TFTs), and the manufacturing yield can be improved.

Fourth Embodiment

Figure 11:
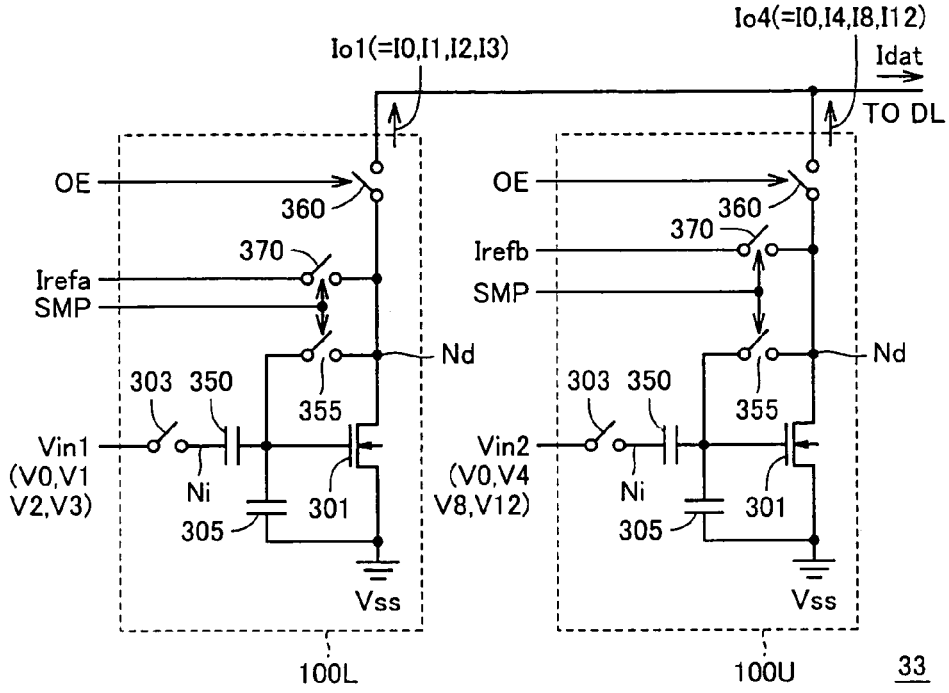
FIG. 11 is a circuit diagram showing a structure of a data current generating circuit according to a fourth embodiment of the invention.

Referring to FIG. 11, a data current generating circuit 33 according to a fourth embodiment includes two analog current supply circuits 100L and 100U. Each of analog current supply circuits 100L and 100U has a structure similar to that of analog current supply circuit 100 already described, and therefore description thereof is not repeated.

In the current output operation, analog current supply circuits 100L and 100U are supplied with input voltages Vin1 and Vin2 similar to those in FIG. 9, respectively. In the calibration operation, analog current supply-circuits 100L and 100U are supplied with reference currents Irefa and Irefb for the calibration operation.

Figure 12:
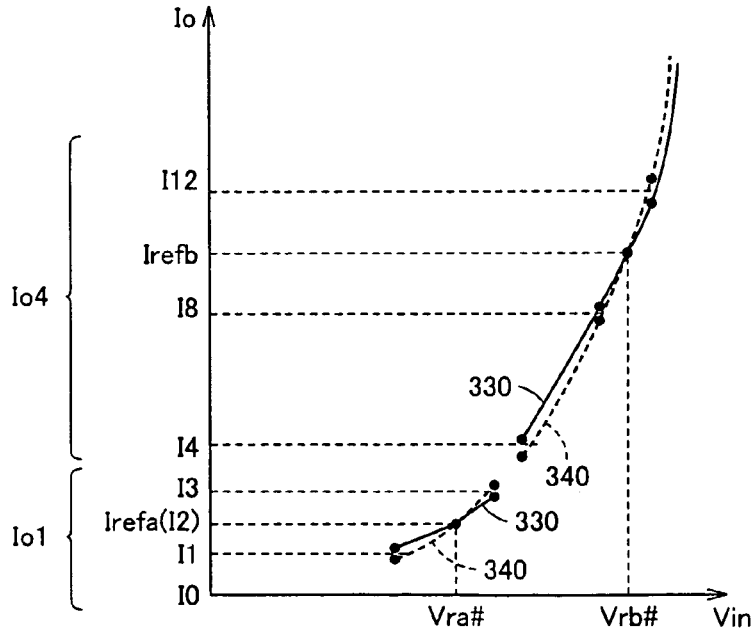
FIG. 12 illustrates variations in output current of the data current generating circuit according to the fourth embodiment.

FIG. 12 illustrates the variations in output current of the data current generating circuit according to the fourth embodiment.

Referring to FIG. 12, analog current supply circuit 100L produces current Io1 according to characteristic lines 330 and 340 already described with reference to FIG. 7. More specifically, by setting reference current Irefa to a level (e.g., of current I2) intermediate between currents I1 and I3, current variations ΔI1–ΔI3 in currents I1–I3 can be suppressed similarly to the manner illustrated in FIG. 8.

Likewise, analog current supply circuit 100U produces current Io4 according to characteristic lines 330 and 340 already described with reference to FIG. 7. More specifically, by setting reference current Irefb to a level intermediate between currents I4 and I12, the maximum value of current variations ΔI4, ΔI8 and ΔI12 in currents I4, I8 and I12 can be suppressed.

On FIG. 12, the level of input voltage Vin providing output current Io1 equal to Irefa is represented by Vra#, and the level of input voltage Vin providing output current Io4 equal to Irefb is represented by Vrb#.

In the data current generating circuit according to the fourth embodiment, therefore, currents I0–I15 for 16 gray levels can be produced as data current Idat from the sum of output current Io1 (=I0, I1, I2, I3) provided from analog current supply circuit 100L and output current Io4 (=I0, I4, I8 and I12) provided from analog current supply circuit 100U.

According to the data current generating circuit of the fourth embodiment, two analog current supply circuits 100L and 100U can produce data current Idat for 16 gradations so that the circuit footprint can be further reduced.

In connection with the variations in data current Idat, the variations in output current can be suppressed in the high gray levels region, as compared with at least such a case that analog current supply circuit 100 or 400 is used alone, although data current generating circuit 50 of the digital type, which has been described as an example for comparison, can suppress such variations further effectively. Similarly to the first to third embodiments, therefore, it is possible to ensure large allowable variations in transistor characteristics at the time of manufacturing of the current drive elements (TFTs), and the manufacturing yield can be improved.

Fifth Embodiment

Figure 13:
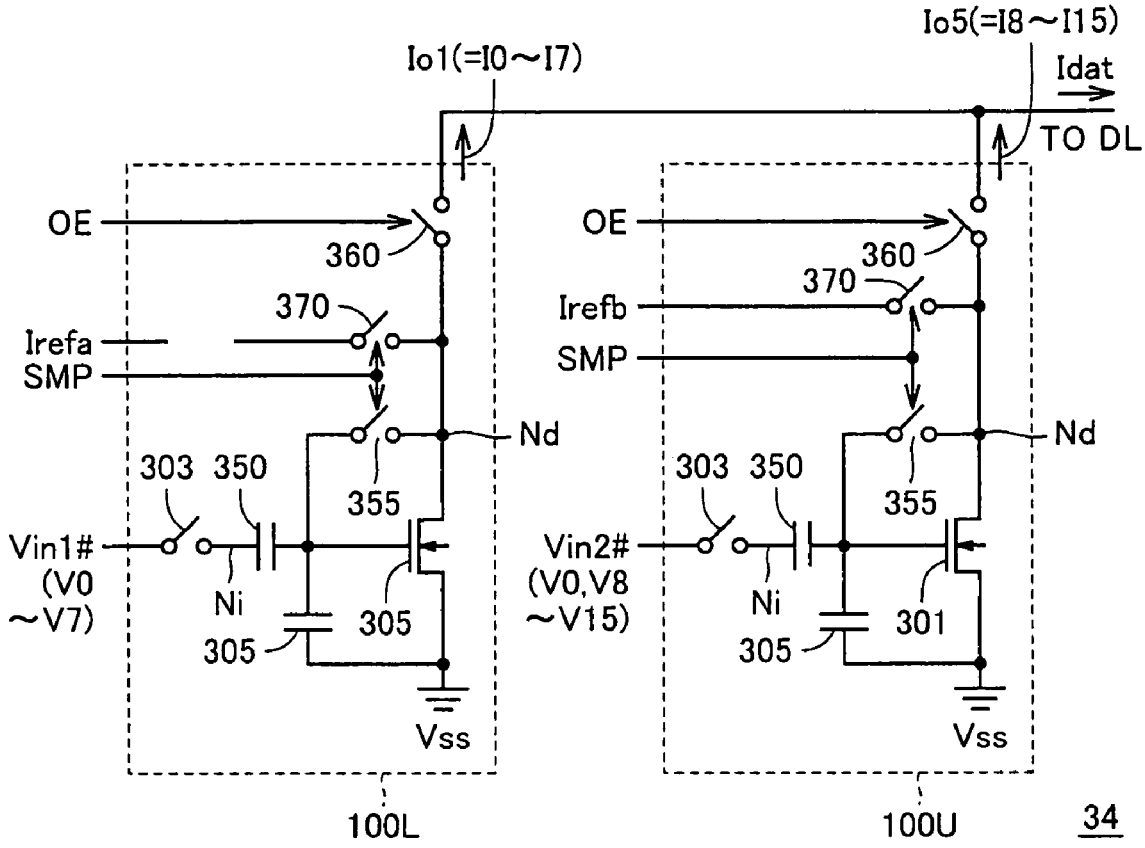
FIG. 13 is a circuit diagram showing a structure of a data current generating circuit according to a fifth embodiment of the invention.

Referring to FIG. 13, a data current generating circuit 34 according to a fifth embodiment has a structure similar to that of data current generating circuit 33 of the fourth embodiment shown in FIG. 11 except for that input voltages Vin1# and Vin2# are used. Other structures are the same as those of data current generating circuit 33 according to the fourth embodiment, and therefore description thereof is not repeated.

In the structure according to the fifth embodiment, the plurality of analog current supply circuits 100 are used to divide, in advance, the whole gradation range of data current Idat into a plurality of current ranges, and analog current supply circuits 100 operate corresponding to the plurality of current ranges for producing the data current, respectively. Thus, data current Idat is not produced from the sum of output currents of the plurality of analog current supply circuits, but is achieved by one analog current supply circuit 100 selected in accordance with the display signal.

FIG. 13 shows a structure example, in which the whole gradation range I0–I15 of data current Idat is divided irito two current ranges I0–I7 and I8–I15, analog current supply circuit 100L outputs currents I0–I7, and analog current supply circuit 100U outputs currents I8–I15.

Setting is performed according to data bits D0–D3 as follows. In the case of ((D0, D1, D2, D3)=(0, 0, 0, 0), • • • (0, 1, 1, 1)), input voltage Vin1# is set to one of voltages V0–V7, and input voltage Vin2# is set to voltage V0. In the case of ((D0, D1, D2, D3)=(1, 0, 0, 0), • • • (1, 1, 1, 1)), input voltage Vin2# is set to one of voltages V8–V15, and input voltage Vin1# is set to voltage V0.

According to data current generating circuit 34 of the fifth embodiment, since only the selected one of analog current supply circuits 100 supplies data current Idat, each analog current supply circuit 100 may be configured to turn on/off its switch 360 in accordance with a result of the selection. For example, the structure example shown in FIG. 13 may be configured to turn on/off switches 360 in analog current supply circuits 100U and 100L complimentarily to each other in accordance with the level of data bit D3.

Figure 14:
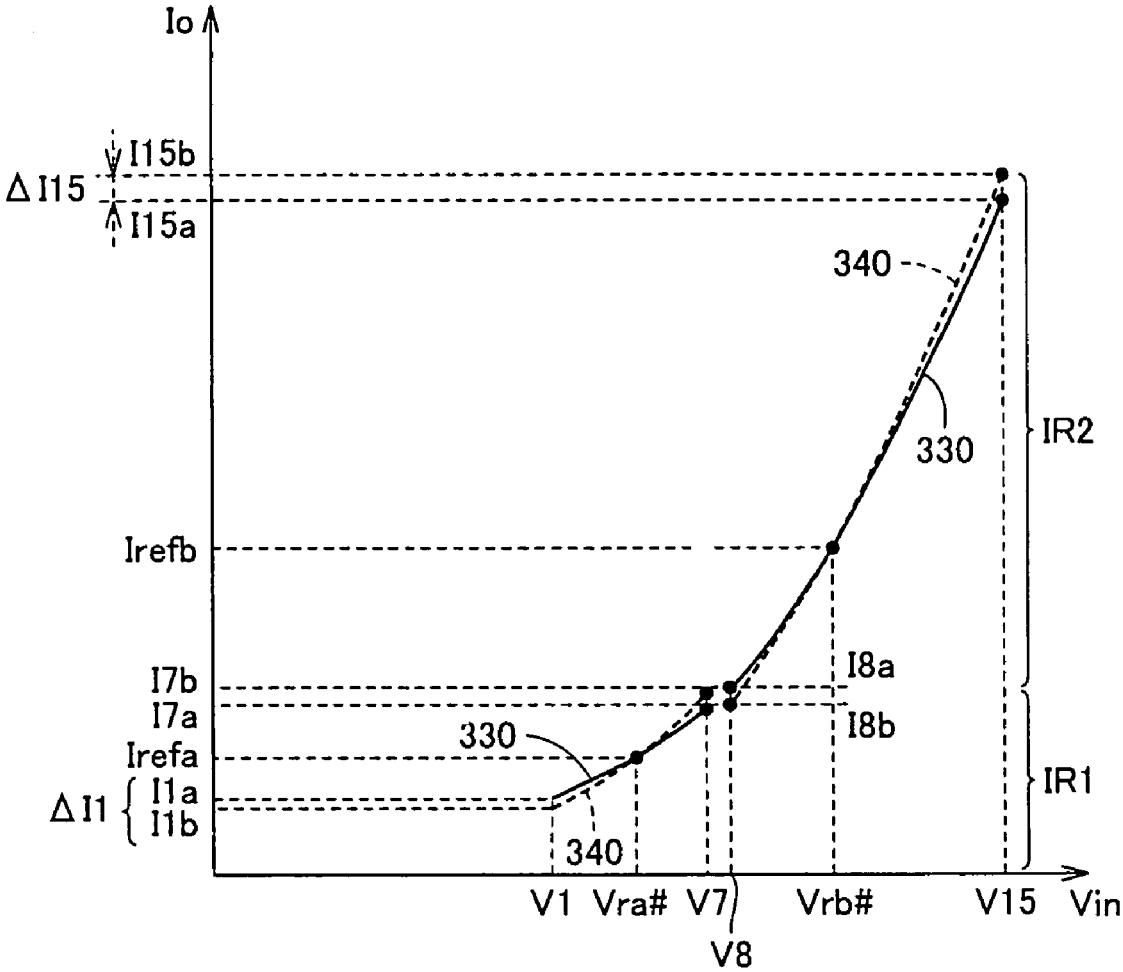
FIG. 14 illustrates variations in output current of the data current generating circuit according to the fifth embodiment.

FIG. 14 illustrates variations of the output current of the data current generating circuit according to the fifth embodiment.

Referring to FIG. 14, current variations in a current range IR1 corresponding to currents I0–I7 increase according to characteristic lines 330 and 340 already described with reference to FIG. 7, and particularly increase with a level difference between reference current Irefa and each output current (data current Idat). Likewise, current variations in a current range IR2 corresponding to currents I8–I15 increase according to characteristic lines 330 and 340, and particularly increase with the level difference between reference current Irefb and each output current (data current Idat).

Accordingly, current variations ΔI1–ΔI15 in currents I1–I15 depend on the levels, to which reference currents Irefa and Irefb are set in analog current supply circuits 100U and 100L, respectively.

In particular, reference currents Irefa and Irefb must be set so that gray-scale inversion may not occur at a boundary between current ranges IR1 and IR2.

More specifically, in the example of FIG. 14, variations ΔI7 related to current I7 depend on |I7−Irefa|, and variations ΔI8 related to current I8 depend on |I8−Irefb|. If inversion between currents I7 and I8 (i.e., a situation of (I7*b*>I8*a*) in FIG. 14) occurs due to an influence by current variations ΔI7 and ΔI8, the gray scale inversion occurs, and smooth gray-scale expression cannot be performed. Therefore, reference currents Irefa and Irefb must be set in view of the above.

According to the data current generating circuit of the fifth embodiment, two analog current supply circuits 100L and 100U can generate the whole gradation range of data current Idat so that the circuit footprint can be further reduced.

In connection with the variations in data current Idat, the variations in output current can be suppressed in the high gradation region, as compared with at least such a case that analog current supply circuit 100 or 400 is used alone, although data current generating circuit 50 of the digital type, which has been described as an example for comparison, can suppress such variations further effectively. Similarly to the first to third embodiments, therefore, it is possible to ensure large allowable variations in transistor characteristics at the time of manufacturing of the current drive elements (TFTs), and the manufacturing yield can be improved.

FIGS. 13 and 14 show by way of example the structures, in which two analog current supply circuits 100U and 100L cover the whole gradation range of data current Idat. However, three or more analog current supply circuits 100 may be used to achieve a similar structure. In this case, the whole gradation range of data current Idat is divided, in advance, into current ranges corresponding in number to analog current supply circuits 100, and each analog current supply circuit produces data current Idat in the corresponding current range. By increasing the number of analog current supply circuits 100, the variations in data current Idat can be suppressed, but conversely the effect of reducing the circuit footprint is impaired.

Likewise, in the data current generating circuits according to the third and fourth embodiments shown in FIGS. 9 and 11, respectively, a plurality of analog current supply circuits 100U may be employed for the higher bits, and may be configured to operate for different current ranges, respectively. In this case, variations in the output current (Io4=I4, I8, I12 in FIGS. 9 and 11) for the higher bits can be suppressed, but conversely the effect of reducing the circuit footprint is impaired.

Sixth Embodiment

In a sixth embodiment described below, a plurality of (preferably two) data current generating circuits each having the same structure as that of one of the first to fifth embodiments are employed for each data line DL, and are configured to execute in parallel and alternately the calibration operation and the current output operation.

Figure 15:
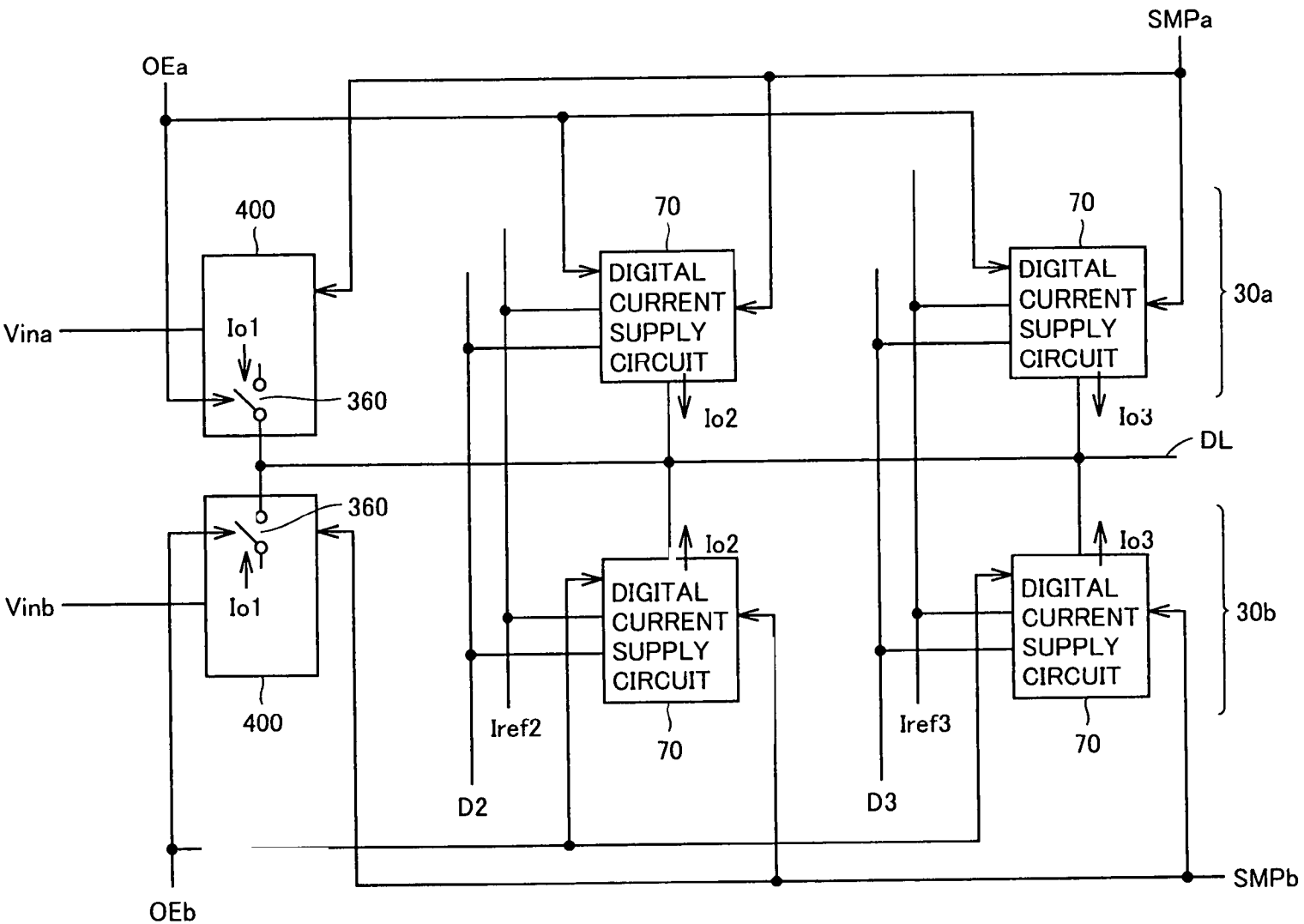
FIG. 15 is a block diagram showing a structure of a data current generating circuit according to a first structure example of a sixth embodiment.

FIG. 15 is a block diagram showing a structure of a data current generating circuit of a first structure example of the sixth embodiment.

FIG. 15 shows a structure, in which two data current generating circuits 30*a* and 30*b* according to the first embodiment are provided for each data line DL. Each of data current generating circuits 30*a* and 30*b* has a structure similar to that of data current generating circuit 30 shown in FIG. 4, and therefore description thereof is not repeated.

Each of digital current supply circuits 70 and analog current supply circuit 400 forming data current generating circuit 30*a* is supplied with control signals SMPa and OEa. Analog current supply circuit 400 is supplied with input voltage Vina.

Each of digital current supply circuits 70 and analog current supply circuit 400 forming data current generating circuit 30*b* is supplied with control signals SMPb and OEb. Analog current supply circuit 400 is supplied with input voltage Vinb.

Data current generating circuits 30*a* and 30*b* alternately execute the calibration operation and the current output operation. During a certain period, for example, data current generating circuit 30*a* executes the calibration operation, and data current generating circuit 30*b* executes the current output operation. During this period, control signals SMPa and OEb are set to the H-level, and control signals SMPb and OEa are set to the L-level. Further, input voltage Vina is set to the reset voltage Vr, and input voltage Vinb is set similarly to voltage Vin already described in connection with the first embodiment.

Conversely, during such a period that data current generating circuit 30*b* executes the calibration operation, and data current generating circuit 30*a* executes the current output operation, control signals SMPb and OEa are set to the H-level, and control signals SMPa and OEb are set to the L-level. Further, input voltage Vinb is set to the reset voltage Vr, and input voltage Vina is set similarly to voltage Vin already described in connection with the first embodiment.

Such switching of control signals SMPa and SMPb, control signals OEa and OEb, and input voltages Vina and Vinb may be executed, e.g., in synchronization with the switching of the scanning lines already described with reference to FIG. 1.

Figure 16:
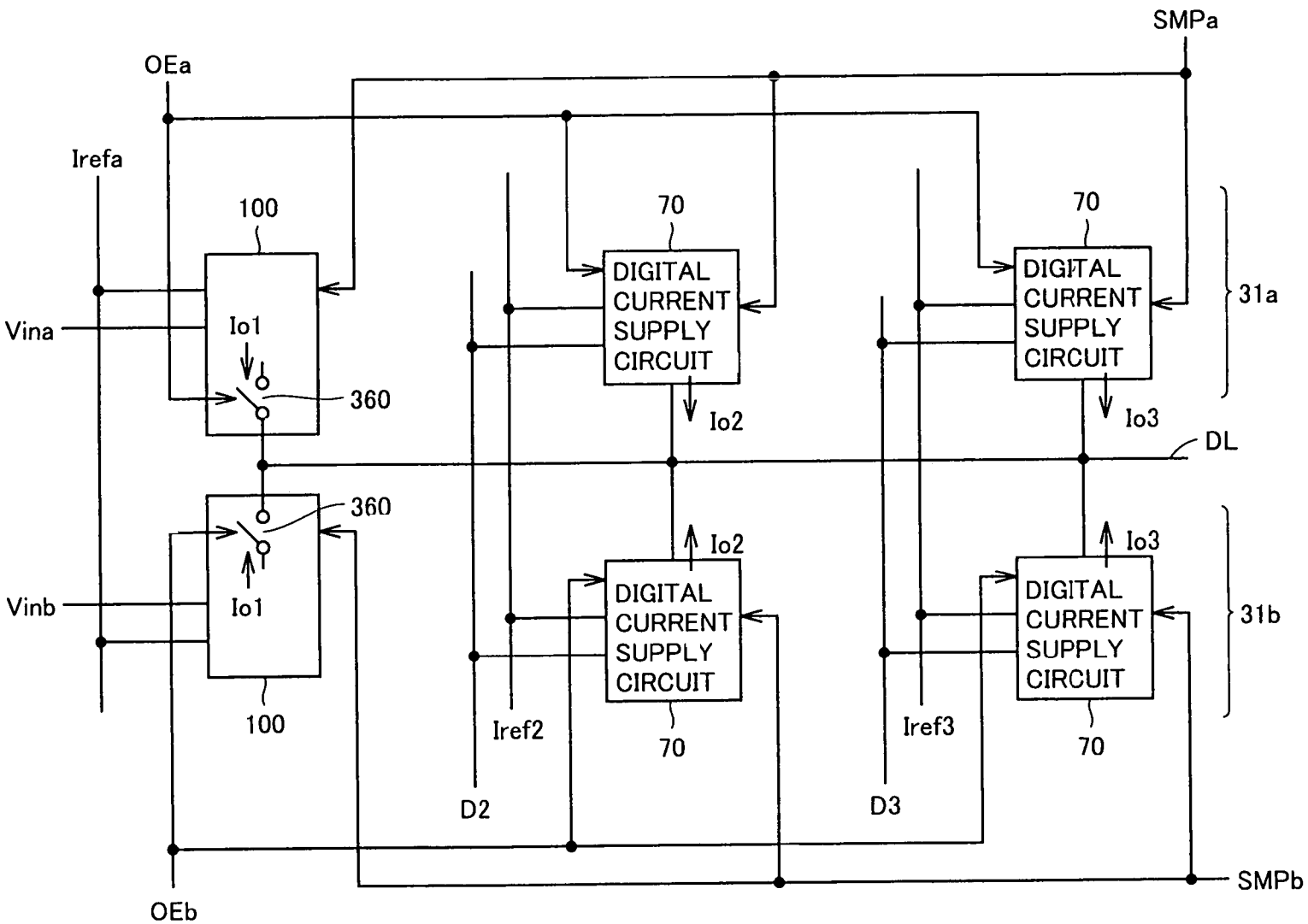
FIG. 16 is a block diagram showing a structure of a data current generating circuit according to a second structure example of the sixth embodiment.

FIG. 16 is a block diagram showing a second structure example of the data current generating circuit according to the sixth embodiment.

FIG. 16 shows a structure, in which two data current generating circuits 31*a* and 31*b* according to the second embodiment are provided for each data line DL. Each of data current generating circuits 31*a* and 31*b* has a structure similar to that of data current generating circuit 31 shown in FIG. 6, and therefore description thereof is not repeated.

Each of digital current supply circuits 70 and analog current supply circuit 100 forming data current generating circuit 31*a* is supplied with control signals SMPa and OEa. Analog current supply circuit 100 is supplied with input voltage Vina.

Each of digital current supply circuits 70 and analog current supply circuit 100 forming data current generating circuit 31*b* is supplied with control signals SMPb and OEb. Analog current supply circuit 100 is supplied with input voltage Vinb.

Control signals SMP and SMPb, control signals OEa and OEb, and input voltages Vina and Vinb are set similarly to those in the structure example shown in FIG. 15.

Figure 17:
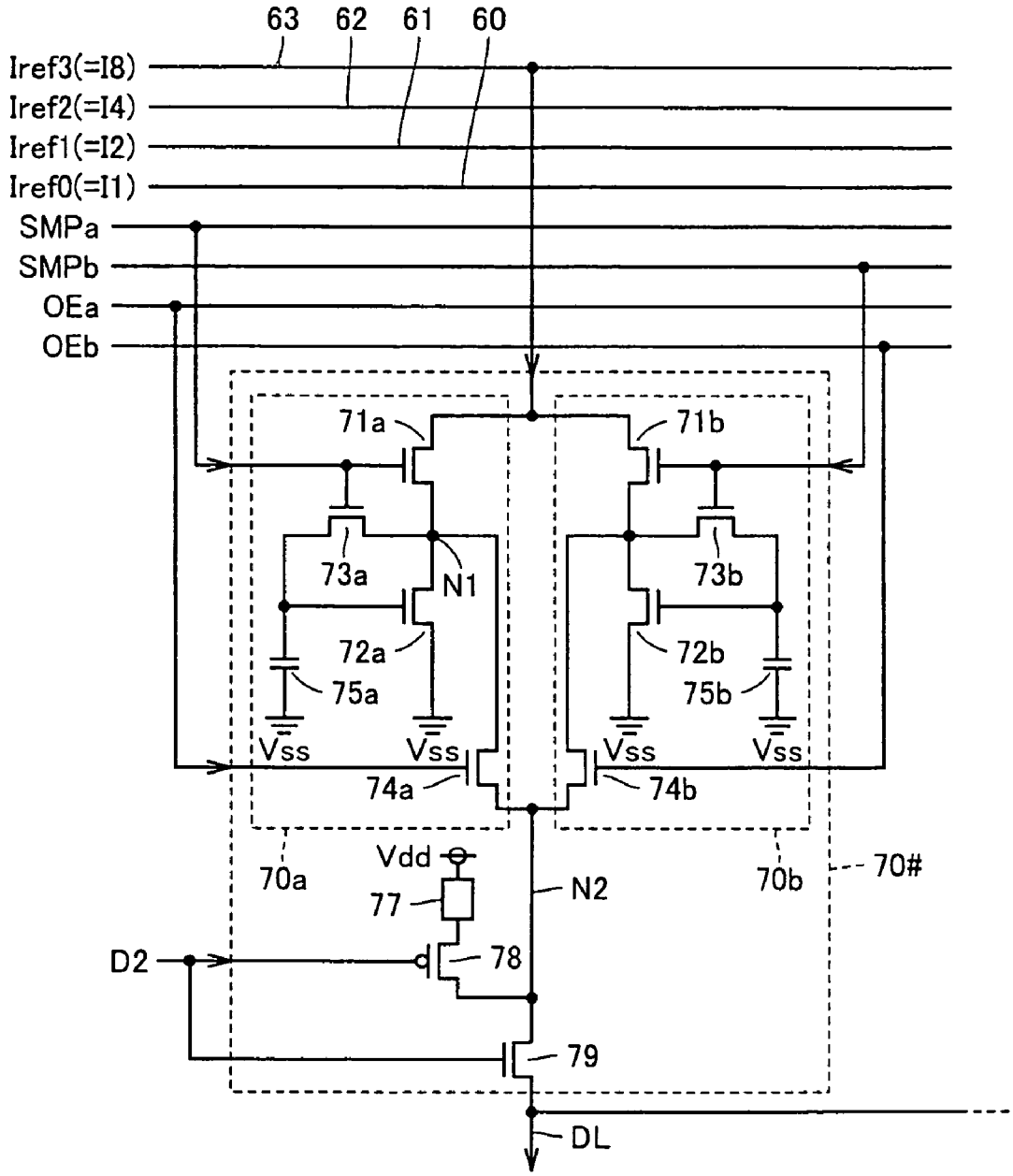
FIG. 17 is a circuit diagram showing a structure of a digital current supply used in a data current generating circuit according to the sixth embodiment.

In the structure employing the two data current generating circuits as shown in FIGS. 15 and 16, the digital current supply may have an efficient structure as shown in FIG. 17.

Referring to FIG. 17, a digital current supply circuit 70# used in the data current generating circuit according to the sixth embodiment includes two digital current supplies 70*a* and 70*b*, and also includes dummy load 77, p-type TFT 78 and n-type TFT 79, which are provided commonly to digital current supplies 70*a* and 70*b*.

Each of digital current supplies 70*a* and 70*b* has the same structure as digital current supply circuit 70 shown in FIG. 3 except for that dummy load 77, p-type TFT 78 and n-type TFT 79 are not included. Digital current supplies 70*a* and 70*b* share node N2, and n-type TFT 79 is connected between node N2 and corresponding data line DL. Dummy load 77 and p-type TFT 78 are connected in series between node N2 and power supply voltage Vdd. Each of p-and n-type TFTs 78 and 79 receives on its gate the corresponding data bit (e.g., D2 in FIG. 17).

According to the above structure, since the two digital current supplies can be arranged to share dummy load 77, p-type TFT 78 and n-type TFT 79, the circuit footprint can be smaller than that of the structure, in which two digital current supply circuits 70 are arranged in parallel.

FIG. 17 representatively shows a structure of digital current supply circuit 70# corresponding to data bit D2. This structure is substantially the same as that of digital current supply circuit 70# corresponding to data bit D3 except for that each of p-and n-type TFTs 78 and 79 of the latter receive data bit D3 on its gate.

Figure 18:
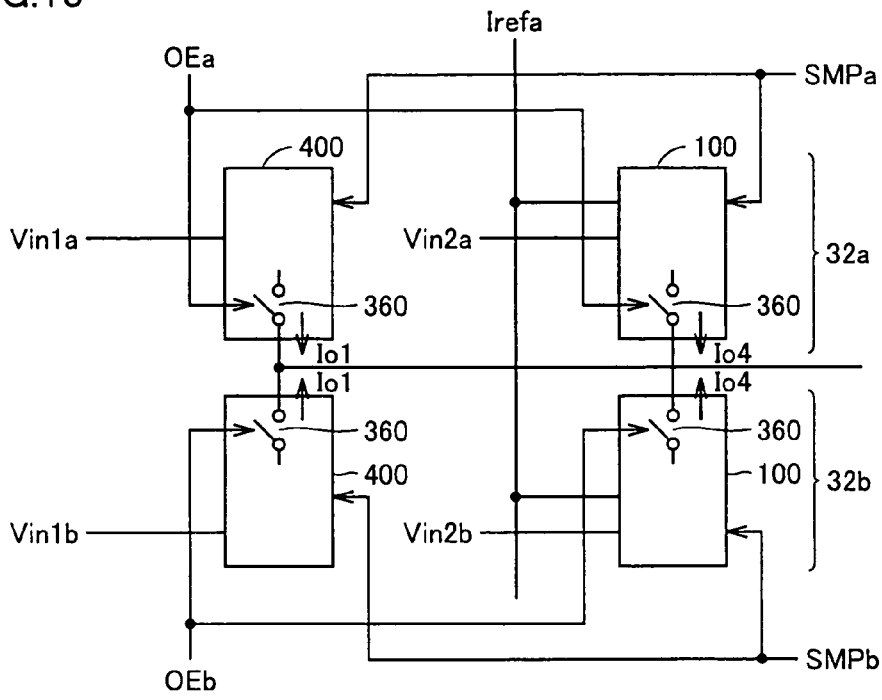
FIG. 18 is a block diagram showing a structure of a data current generating circuit according to a third structure example of the sixth embodiment.

FIG. 18 is a block diagram showing a structure of a data current generating circuit according to a third structure example of the sixth embodiment.

FIG. 18 shows a structure, in which two data current generating circuits 32*a* and 32*b* each having the structure according to the third embodiment are provided for each data line DL. Each of data current generating circuits 32*a* and 32*b* has substantially the same structure as data current generating circuit 32 shown in FIG. 9, and therefore description thereof is not repeated.

Each of analog current supply circuits 100 and 400 forming data current generating circuit 32*a* is supplied with control signals SMPa and OEa. Analog current supply circuit 400 is also supplied with input voltage Vin1*a*, and analog current supply circuit 100 is supplied with input voltage Vin2*a*.

Each of analog current supply circuits 100 and 400 forming data current generating circuit 32*b* is supplied with control signals SMPb and OEb. Analog current supply circuit 400 is also supplied with input voltage Vin1*b*, and analog current supply circuit 100 is supplied with input voltage Vin2*b*.

During such a period that data current generating circuit 32*a* executes the calibration operation, and data current generating circuit 32*b* executes the current output operation, input voltages Vin1*a* and Vin2*a* are set to reset voltage Vr, and input voltages Vin1*b* and Vin2*b* are set similarly to voltages Vin1 and Vin2 already described in connection with the third embodiment, respectively.

During such a period that data current generating circuit 32*b* executes the calibration operation, and data current generating circuit 32*a* executes the current output operation, input voltages Vin1*b* and Vin2*b* are set to reset voltage Vr, and input voltages Vin1*a* and Vin2*a* are set similarly to voltages Vin1 and Vin2 already described in connection with the third embodiment, respectively. Control signals SMPa and SMPb as well as control signals OEa and OEb are set similarly to the structure example in FIG. 15.

Figure 19:
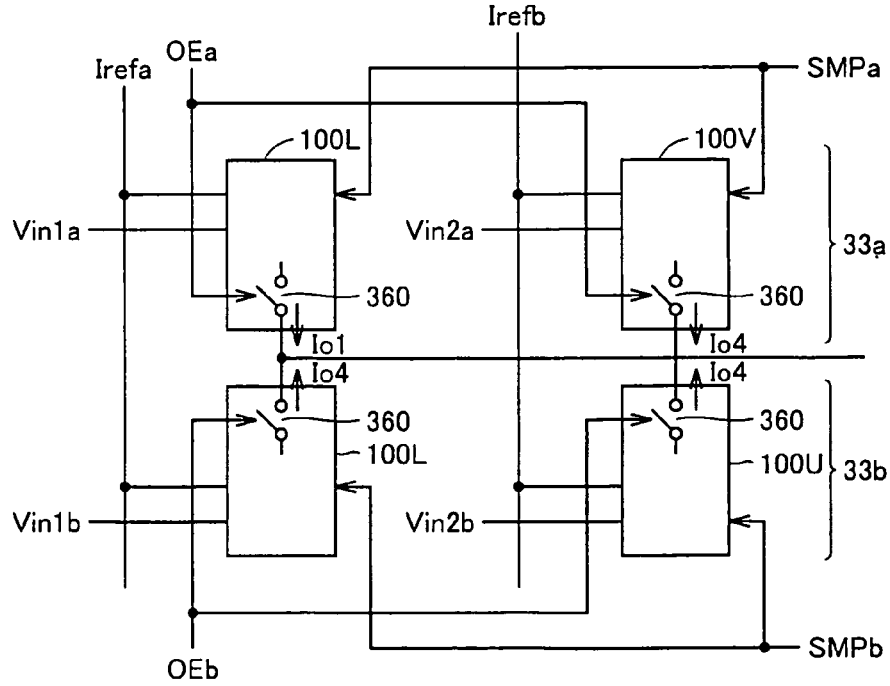
FIG. 19 is a block diagram showing a structure of a data current generating circuit according to a fourth structure example of the sixth embodiment.

FIG. 19 is a block diagram showing a structure of a data current generating circuit according to a fourth structure example of the sixth embodiment.

FIG. 19 shows a structure, in which two data current generating circuits 33*a* and 33*b* each having the structure according to the fourth embodiment are provided for each data line DL. Each of data current generating circuits 33*a* and 33*b* has substantially the same structure as data current generating circuit 33 shown in FIG. 11, and therefore description thereof is not repeated.

Each of analog current supply circuits 100L and 100U forming data current generating circuit 33*a* is supplied with control signals SMPa and OEa. Analog current supply circuit 100L is supplied with input voltage Vin1*a*, and analog current supply circuit 100U is supplied with input voltage Vin2*a*.

Each of analog current supply circuits 100L and 100U forming data current generating circuit 33*b* is supplied with control signals SMPb and OEb. Analog current supply circuit 100L is supplied with input voltage Vin1*b*, and analog current supply circuit 100U is supplied with input voltage Vin2*b*.

Control signals SMPa and SMPb, control signals OEa and OEb, and input voltages Vin1*a*, Vin2*a*, Vin1*b* and Vin2*b* are set similarly to those in the structure example shown in FIG. 17, and therefore description thereof is not repeated.

Figure 20:
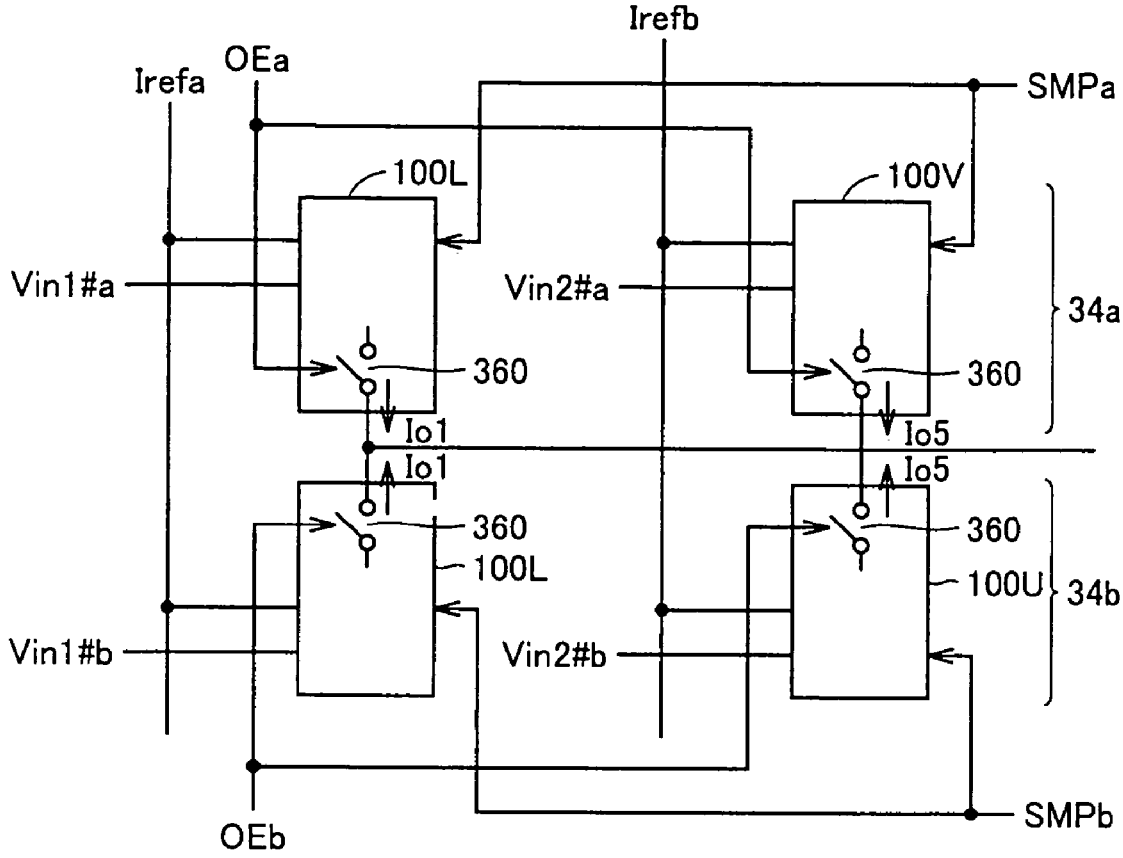
FIG. 20 is a block diagram showing a structure of a data current generating circuit according to a fifth structure example of the sixth embodiment.
Figure 21:
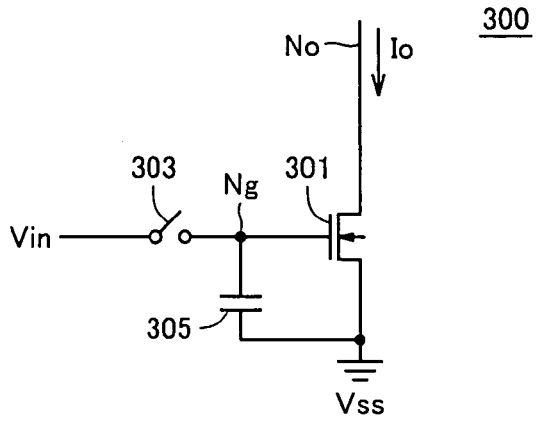
FIG.21 PRIOR ART
FIG. 21 is a circuit diagram showing a structure of a conventional current supply circuit.

FIG. 20 is a block diagram showing a structure of a data current generating circuit according to a fifth structure example of the sixth embodiment.

FIG. 20 shows a structure, in which data current generating circuits 34*a* and 34*b* according to the fifth embodiment are provided for each data line DL. Each of data current generating circuits 34*a* and 34*b* has the same structure as data current generating circuit 34 shown in FIG. 13, and therefore description thereof is not repeated.

Each of analog current supply circuits 100L and 100U forming data current generating circuit 34*a* is supplied with control signals SMPa and OEa. Analog current supply circuit 100L is supplied with input voltage Vin1#a, and analog current supply circuit 100U is supplied with input voltage Vin2#a.

Each of analog current supply circuits 100L and 100U forming data current generating circuit 34*b* is supplied with control signals SMPb and OEb. Analog current supply circuit 100L is supplied with input voltage Vin1#b, and analog current supply circuit 100U is supplied with input voltage Vin2#b.

During such a period that data current generating circuit 32*a* executes the calibration operation, and data current generating circuit 32*b* executes the current output operation, input voltages Vin1#a and Vin2#a are set to reset voltage Vr, and input voltages Vin1#b and Vin2#b are set similarly to voltages Vin1# and Vin2# already described in connection with the fifth embodiment, respectively.

During such a period that data current generating circuit 32*b* executes the calibration operation, and data current generating circuit 32*a* executes the current output operation, input voltages Vin1#b and Vin2#b are set to reset voltage Vr, and input voltages Vin1#a and Vin2#a are set similarly to voltages Vin1# and Vin2# already described in connection with the fifth embodiment, respectively. Control signals SMPa and SMPb as well as control signals OEa and OEb are set similarly to the structure example in FIG. 19.

According to the data current generating circuit of the sixth embodiment described above, since the two data current generating circuits can execute in parallel the calibration operation and the current output operation, each analog current supply circuit and each digital current supply circuit can performed the calibration operation more frequently so that variations in data current can be reduced. Further, it is possible to ensure intended accuracy of the data current, and to perform fast display of moving pictures or the like.

Since a long time can be ensured for the calibration operation of each current supply circuit, the calibration operation can be performed with high accuracy even in a display panel of high resolution.

Although the first to sixth embodiments have been described in connection with the gray-scale expression using the display signal of four bits, the invention can be applied to display devices using display signals other than four bits. Thus, the invention can be commonly applied to the display devices performing the gray-scale expression based on the display signals of n bits (n: integer larger than two).

According to the combinations of one of the analog current supply circuits and the digital current supply circuits with the structure of the pixel shown in FIG. 2, the structure generates data current Idat flowing from data line DL to data current generating circuits 30–34. However, the invention can likewise be applied to a display device, in which pixels as well as digital and analog current supply circuits have some other structures to cause the data current in the opposite direction. Thus, the invention is not restricted to the examples of the pixel structures in the embodiments already described, but can be commonly applied to display devices, in which a current drive element is provided in each pixel.

The TFTs in the embodiments may be made of any one of single crystal silicon, amorphous silicon, low-temperature polycrystalline silicon, organic thin film and others.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A display device for gray-scale expression based on a display signal of weighted n bits (where n is an integer larger than two), comprising:

a plurality of pixels, each pixel having a light-emitting element exhibiting brightness according to a supplied current;

a scanning portion periodically selecting said pixels in a predetermined manner; and a data current generating circuit supplying a data current, according to the display signal, to at least one of said pixels selected by said scanning portion, wherein said data current generating circuit includes an analog current supply circuit generating an output current corresponding to an input voltage set in accordance with lower k bits (where k is an integer satisfying $(2 \leqq k \leqq (n-1))$) of the display signal, and digital current supply circuits, j (where j is an integer equal to (n−k)) in number, corresponding to higher j bits of the display signal, and operating to generate and stop generation of the 1st to jth bit-weighted currents corresponding to the higher j bits, respectively, and supplies, as the data current, a sum of currents generated by said j digital current supply circuits and said analog current supply circuit, and the output current produced by said analog current supply circuit is controlled within a range lower that the smallest of the 1st to jth bit-weighted currents.

2. The display device according to claim 1, wherein said analog current supply circuit calibrates at a predetermined point on a characteristic line representing a relationship between the input voltage and the output current, and the predetermined point is within the range of the output current of said analog current supply circuit.

3. The display device according to claim 1, wherein said analog current supply circuit includes:

an input node supplied with a predetermined initial voltage in a calibration operation, and supplied with the input voltage in a current output operation, a first capacitor connected to transmit a change in voltage on said input node to a first internal node by capacitive coupling, a first field-effect transistor having a source and a drain connected to a predetermined voltage and a second internal node, respectively, and having a gate connected to said first internal node, a second capacitor connected to hold a gate-source voltage of said first field-effect transistor, a first switch element arranged between said second internal node and a first output node, carrying the output current, being turned off in the calibration operation and being turned on in the current output operation, and a second switch element arranged between said first and second internal nodes, being turned on in the calibration operation and being turned off in the current output operation.

4. The display device according to claim 3, wherein said digital current supply circuit includes:

a second field-effect transistor having a source and a drain connected to a predetermined voltage and a third internal node, respectively, a third capacitor connected to hold a gate-source voltage of said second field-effect transistor, a third switch element arranged between the gate and the drain of said second field-effect transistor, being turned on in the calibration operation and being turned off in the current output operation, a reference current supply portion supplying a reference current representing a reference level of the corresponding bit-weighted current to said third internal node in the calibration operation, and a fourth switch element arranged between said third internal node and a second output node, carrying the bit-weighted current, isolating said third internal node from said second output node in the calibration operation, and connecting said third internal node to said second output node in accordance with a corresponding bit among the higher j bits in the current output operation.

5. The display device according to claim 1, wherein said analog current supply circuit includes:

an input node supplied with a predetermined initial voltage in a calibration operation, and supplied with the input voltage in a current output operation, a first capacitor connected to transmit a change in voltage on said input node to a first internal node by capacitive coupling, a first field-effect transistor having a source and a drain connected to a predetermined voltage and a second internal node, respectively, and having a gate connected to said first internal node, a second capacitor connected to hold a gate-source voltage of said first field-effect transistor, a first switch element arranged between said second internal node and a first output node, carrying the output current, being turned off in the calibration operation and being turned on in the current output operation, a second switch element arranged between said first and second internal nodes, being turned on in the calibration operation and being turned off in the current output operation, and a first reference current supply portion supplying a first reference current to said second internal node in the calibration operation, and said first reference current is set within the range of the output current of said analog current supply circuit.

6. The display device according to claim 5, wherein each of said digital current supply circuits includes:

a second field-effect transistor having a source and a drain connected to a predetermined voltage and a third internal node, respectively, a third capacitor connected to hold a gate-source voltage of said second field-effect transistor, a third switch element arranged between the gate and the drain of said second field-effect transistor, being turned on in the calibration operation and being turned off in the current output operation, a second reference current supply portion supplying a second reference current representing a reference level of the corresponding bit-weighted current to said third internal node in the calibration operation, and a fourth switch element arranged between said third internal node and a second output node, carrying the bit-weighted current, isolating said third internal node from said second output node in the calibration operation, and connecting said third internal node to said second output node in accordance with a corresponding bit among the higher j bits in the current output operation.

7. The display device according to claim 1, wherein said 1st to jth bit-weighted currents are set stepwise, in accordance with a power of 2.

8. The display device according to claim 1, further comprising a plurality of data lines for transmitting the data current between said data current generating circuit and said plurality of pixels, wherein said data current generating circuit is provided corresponding to each of said plurality of data lines.

9. The display device according to claim 1, including a plurality of said data current generating circuits, wherein said plurality of data current generating circuits execute a calibration operation and a current output operation, in parallel.

10. A display device for gray-scale expression based on a display signal of weighted n bits (where n is an integer larger than two), comprising:

a plurality of pixels, each pixel having a light-emitting element exhibiting brightness according to a supplied current;

a scanning portion periodically selecting said pixels in a predetermined manner; and a data current generating circuit supplying a data current according to the display signal to at least one of said pixels selected by said scanning portion, wherein said data current generating circuit includes a first analog current supply circuit generating a first output current corresponding to a first input voltage set in accordance with lower k bits (where k is an integer satisfying $(2 \leqq k \leqq (n-1))$) of the display signal, and a second analog current supply circuit producing a second output current corresponding to a second input voltage set in accordance with higher j bits (where j is an integer equal to (n−k)) of the display signal, and supplies a sum of the first and second output currents as the data current, a range of the first output current is set on a side lower than a range of the second output current, each of said first and second analog current supply circuits calibrates at a predetermined point on a characteristic line representing a relationship between the input voltage and each of the first and second output currents, and the predetermined point is set in a range of each of the first and second output currents in said first and second analog current supply circuits.

11. The display device according to claim 10, wherein said first analog current supply circuit includes:

a first input node supplied with a predetermined initial voltage in a calibration operation, and supplied with the first input voltage in a current output operation, a first capacitor connected to transmit a change in voltage on said first input node to a first internal node by capacitive coupling, a first field-effect transistor having a source and a drain connected to a predetermined voltage and a second internal node, respectively, and having a gate connected to said first internal node, a second capacitor connected to hold a gate-source voltage of said first field-effect transistor, a first switch element arranged between said second internal node and a first output node carrying the first output current, being turned off in the calibration operation and being turned on in the current output operation, and a second switch element arranged between said first and second internal nodes, being turned on in the calibration operation and being turned off in the current output operation, and said second analog current supply circuit includes:

a second input node supplied with a predetermined initial voltage in the calibration operation, and thereafter supplied with the second input voltage in the current output operation, a third capacitor connected to transmit a change in voltage on said second input node to a third internal node by capacitive coupling, a second field-effect transistor having a source and a drain connected to a predetermined voltage and a fourth internal node, respectively, and having a gate connected to said third internal node, a fourth capacitor connected to hold a gate-source voltage of said second field-effect transistor, a third switch element arranged between said fourth internal node and a second output node carrying the second output current, being turned off in the calibration operation and being turned on in the current output operation, a fourth switch element arranged between said third and fourth internal nodes, being turned on in the calibration operation and being turned off in the current output operation, and a reference current supply portion supplying a reference current to said fourth internal node in the calibration operation, and the reference current is set within a control range of the second output current.

12. The display device according to claim 10, wherein each of said first and second analog currents supply circuits includes:

an input node supplied with a predetermined initial voltage in a calibration operation, a first capacitor connected to transmit a change in voltage on said input node to a first internal node by capacitive coupling, a first field-effect transistor having a source and a drain connected to a predetermined voltage and a second internal node, respectively, and having a gate connected to said first internal node, a second capacitor connected to hold a gate-source voltage of said first field-effect transistor, a first switch element arranged between said second internal node and an output node carrying corresponding one of the first and second output currents, being turned off in the calibration operation and being turned on in the current output operation, a second switch element arranged between said first and second internal nodes, being turned on in the calibration operation and being turned off in the current output operation, and a reference current supply portion supplying a reference current to said second internal node in the calibration operation, said first and second analog current supply circuits set the reference current in control ranges of the first and second output currents, respectively, and said input nodes of said first and second analog current supplies are supplied with the first and second input voltages in the current output operation, respectively.

13. The display device according to claim 10, wherein a plurality of said second analog current supply circuits, not greater in number than (j−1), are provided for the higher j bits, and each of said plurality of second analog current supply circuits sets the input voltage according to a part of the higher j bits.

14. The display device according to claim 10, further comprising a plurality of data lines for transmitting the data current between said data current generating circuit and said plurality of pixels, wherein a corresponding data current generating circuit is provided for each of said plurality of data lines.

15. The display device according to claim 10, including a plurality of said data current generating circuits, and wherein two of said plurality of data current generating circuits execute a calibration operation and a current output operation in parallel.

16. A display device for gray-scale expression based on a display signal of weighted n bits (where n is an integer larger than two), comprising:

a plurality of pixels, each pixel having a light-emitting element exhibiting brightness according to a supplied current;

a scanning portion periodically selecting said pixels in a predetermined manner; and a data current generating circuit supplying a data current set to one of 1st to $2^n$th levels, according to the display signal, to at least one of said pixels selected by said scanning portion, wherein said 1st to $2^n$th levels are divided in advance into current ranges of m (where m is an integer satisfying ($2 \leqq m < n$)) in number, said data current generating circuit includes analog current supply circuits, m in number, corresponding to the m current ranges, respectively, and each producing an output current corresponding to an input voltage, said display device further comprises a signal processing circuit applying the input voltage according to the display signal to said m analog current supply circuits, said signal processing circuit applies, in accordance with the display signal, the input signal setting the output current to one of the 1st to $2^n$th levels to the analog current supply circuit corresponding to a selected one of the m current ranges, and applies said input voltage setting the output current to each of the other analog current supply circuits to zero, each of said m analog current supply circuits calibrates at a predetermined point on a characteristic line representing a relationship between the input voltage and the output current, and the predetermined point in each of said m analog current supply circuits is set within one corresponding current range among the m current ranges.

17. The display device according to claim 16, wherein the predetermined point of each of said m analog current supply circuits is set such that a relationship in magnitude between a kth level (where k is an integer satisfying $(2 \leqq k \leqq (2^n-2))$ and a (k+1)th level belonging to the different current ranges, respectively, may not be inverted at a boundary of the current range.

18. The display device according to claim 16, wherein each of said m analog current supply circuits includes:

an input node supplied with a predetermined initial voltage in a calibration operation, and supplied with said input voltage in a current output operation, a first capacitor connected to transmit a change in voltage on said input node to a first internal node by capacitive coupling, a first field-effect transistor having a source and a drain connected to a predetermined voltage and a second internal node, respectively, and having a gate connected to said first internal node, a second capacitor connected to hold a gate-source voltage of said first field-effect transistor, a first switch element arranged between said second internal node and a first output node carrying the output current, being turned off in the calibration operation and being turned on in the current output operation, a second switch element arranged between said first and second internal nodes, being turned on in the calibration operation and being turned off in the current output operation, and a reference current supply portion supplying a reference current to said second internal node in the calibration operation, and the reference current in each of said m analog current supply circuits is set within the corresponding current range.

19. The display device according to claim 16, further comprising a plurality of data lines for transmitting the data current between said data current generating circuit and said pixels, wherein a corresponding data current generating circuit is provided for each of said plurality of data lines.

20. The display device according to claim 16, including a plurality of said data current generating circuits, and said plurality of data current generating circuits execute a calibration operation and a current output operation in parallel.

* * * * *